US008834132B2

(12) United States Patent
Kato et al.

(10) Patent No.: US 8,834,132 B2
(45) Date of Patent: Sep. 16, 2014

(54) APPARATUS HAVING CONTROL VALVE AND VARIABLE CAPACITANCE PUMP AND HYDRAULIC PRESSURE CIRCUIT OF INTERNAL COMBUSTION ENGINE IN WHICH THE SAME APPARATUS IS USED

(75) Inventors: Hiroyuki Kato, Koza-gun (JP); Yoshinori Ichinosawa, Atsugi (JP); Yasushi Watanabe, Aiko-gun (JP); Hideaki Ohnishi, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 809 days.

(21) Appl. No.: 12/876,351

(22) Filed: Sep. 7, 2010

(65) Prior Publication Data

US 2011/0085921 A1 Apr. 14, 2011

(30) Foreign Application Priority Data

Oct. 8, 2009 (JP) ..... 2009-234148

(51) Int. Cl.
*F04B 49/00* (2006.01)
*F01C 1/00* (2006.01)

(Continued)

(52) U.S. Cl.
CPC ..... *F01M 1/12* (2013.01); *F01L 2001/34469* (2013.01); *F01M 9/10* (2013.01); *F01M 1/16* (2013.01); *F01L 1/3442* (2013.01); *F01M 2001/0238* (2013.01); *F04C 2/3442* (2013.01); *F04C 14/22* (2013.01); *F01L 2001/3443* (2013.01); *F01M 2001/0246* (2013.01); *F01L 2001/34453* (2013.01); *F04C 14/24* (2013.01)
USPC ..... 417/213; 417/212; 418/256; 418/24; 418/29; 91/516; 123/196 R

(58) Field of Classification Search
CPC ..... F04B 49/08; F04B 49/002; F04B 49/20; F04C 18/3564
USPC ..... 417/212, 219, 221, 213; 418/24, 26–30; 123/190.1, 190.2, 188.4, 188.5, 196 R, 123/90.11, 90.15; 91/516
See application file for complete search history.

(56) References Cited

U.S. PATENT DOCUMENTS 4,452,188 A 6/1984 Kosuda et al.
4,699,571 A * 10/1987 Bartholomaus ..... 417/213

(Continued)

FOREIGN PATENT DOCUMENTS

JP 57-173513 A 10/1982
JP 10-141036 A 5/1998

(Continued)

OTHER PUBLICATIONS

Japanese Office Action dated Feb. 7, 2012 (Three (3) pages).

*Primary Examiner* — Devon Kramer
*Assistant Examiner* — Lilya Pekarskaya
(74) *Attorney, Agent, or Firm* — Crowell & Moring LLP

(57) ABSTRACT

In a hydraulic pressure circuit including an introduction section through which oil is introduced, a main passage section installed at a downstream side of the introduction section to be communicated with a supply section through which oil is supplied to each of slide sections of an internal combustion engine, a branch passage branched from the main passage section to supply oil to a hydraulic pressure actuator, and a control valve having a valve body which is moved in accordance with a pressure of an upstream side thereof, and a variable capacitance pump configured to drain oil to the introduction section, the variable capacitance pump is configured to vary a drained flow quantity in accordance with the drained pressure of oil and a pressure under which the oil drained flow quantity is started to be varied is higher than a pressure under which the valve body is started to move.

7 Claims, 21 Drawing Sheets

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 14/18*** | (2006.01) |
| ***F04C 28/18*** | (2006.01) |
| ***F01C 20/18*** | (2006.01) |
| ***F15B 11/00*** | (2006.01) |
| ***F15B 13/00*** | (2006.01) |
| ***F01M 1/02*** | (2006.01) |
| ***F01M 9/10*** | (2006.01) |
| ***F01M 1/16*** | (2006.01) |
| ***F01M 1/12*** | (2006.01) |
| ***F04C 2/344*** | (2006.01) |
| ***F04C 14/22*** | (2006.01) |
| ***F04C 14/24*** | (2006.01) |
| *F01L 1/344* | (2006.01) |

(56) References Cited

U.S. PATENT DOCUMENTS

| | | | | |
|---|---|---|---|---|
| 5,800,130 | A * | 9/1998 | Blass et al. | 417/213 |
| 5,839,885 | A * | 11/1998 | Oda et al. | 417/213 |
| 5,947,695 | A * | 9/1999 | Nagaoka et al. | 417/213 |
| 6,161,522 | A * | 12/2000 | Fuchita et al. | 123/385 |
| 7,827,947 | B2 | 11/2010 | Ichinosawa et al. | |
| 2006/0127229 | A1 * | 6/2006 | Hunter et al. | 417/222.1 |
| 2007/0295413 | A1 * | 12/2007 | Maeyama et al. | 137/544 |
| 2008/0308062 | A1 | 12/2008 | Morita et al. | |
| 2009/0311115 | A1 * | 12/2009 | Ono et al. | 417/279 |

FOREIGN PATENT DOCUMENTS

| | | | |
|---|---|---|---|
| JP | 11-9910 | A | 1/1999 |
| JP | 2001-336410 | A | 12/2001 |
| JP | 2002-303111 | A | 10/2002 |
| JP | 2008-309049 | A | 12/2008 |
| JP | 2009-97424 | A | 5/2009 |

* cited by examiner

APPARATUS HAVING CONTROL VALVE AND VARIABLE CAPACITANCE PUMP AND HYDRAULIC PRESSURE CIRCUIT OF INTERNAL COMBUSTION ENGINE IN WHICH THE SAME APPARATUS IS USED

BACKGROUND OF THE INVENTION (1) Field of the Invention

The present invention relates to a technique of a control valve configured to supply and distribute oil drained from an oil pump to a variable valve mechanism such as a valve timing control apparatus and each lubricating oil section of an internal combustion engine, a variable capacitance pump, and furthermore is a hydraulic pressure circuit of an internal combustion engine in which the same apparatus having the control valve and the variable capacitance pump is used.

(2) Description of Related Art

A hydraulic pressure which provides a driving source for a hydraulic pressure actuator of, for example, a hydraulic valve timing control apparatus is secured by a branch passage branched from a communication passage communicated with the oil pump and a main oil gallery. There is a high demand for improving an operation response characteristic of the valve timing control apparatus which is the hydraulic pressure actuator, especially the operation response characteristic immediately after the start of engine is high so that, in this case, a pump capacity of an oil pump is needed to be enlarged.

As the technique described in a Japanese Patent Application First Publication No. Showa 57-173513 published on Oct. 25, 1982 (this publication corresponds to a U.S. Pat. No. 4,452,188), a control valve which operates to open and close according to the hydraulic pressure is provided in an oil passage at a downstream side of a branch passage. When a drained pressure of an oil pump at a time of engine start is under a low pressure, oil is supplied with a higher priority to the valve timing control apparatus. When the drained pressure becomes high, the control valve is opened so that a drained flow quantity to a main oil gallery is controlled to become increased.

SUMMARY OF THE INVENTION

However, in the technique described in the above-identified Japanese Patent Application First Publication, in a case where a variable capacitance pump is used in place of an ordinarily available oil pump, the variable capacitance pump is controlled to be operated before the operation of the control valve so that a whole pump draining quantity is decreased. Thus, a technical task of a supply quantity reduction to the main oil gallery, namely, a reduction in an oil supply quantity to each lubricating section of the internal combustion engine is introduced.

It is, hence, an object of the present invention to provide a control valve and a variable capacitance pump and a hydraulic circuit of an internal combustion engine in which the control valve is used, each of which is capable of, at all times, sufficiently achieving an oil supply quantity to the main oil gallery.

The above-described object can be achieved by providing an apparatus comprising: a variable capacitance pump configured to vary a drained flow quantity in accordance with a drained pressure of oil, a hydraulic pressure circuit including an introduction section through which oil is introduced from the variable capacitance pump, a main passage section communicated with a supply section supplying oil to each slide section of an internal combustion engine, and a branch passage branched from the main passage section to supply oil to a hydraulic pressure actuator; and a control valve installed in the hydraulic pressure circuit and configured to control an oil flow quantity to the supply section by moving a valve body thereof in accordance with a pressure of the introduction section, wherein a pressure at the introduction section under which the valve body of the control valve is started to move is lower than a pressure under which the drained flow quantity of the variable capacitance pump is started to be varied.

The above-described object can also be achieved by providing an apparatus comprising: a hydraulic pressure circuit including an introduction section through which oil is introduced, a main passage section installed at a downstream side of the introduction section to be communicated with a supply section through which oil is supplied to each of slide sections of an internal combustion engine, a branch passage branched from the main passage section to supply oil to a hydraulic pressure actuator, and a control valve having a valve body which is moved in accordance with a pressure of an upstream side thereof; and a variable capacitance pump configured to drain oil to the introduction section of the hydraulic pressure circuit, wherein the variable capacitance pump is configured to vary a drained flow quantity in accordance with the drained pressure of oil and a pressure under which the oil drained flow quantity is started to be varied is higher than a pressure under which the valve body of the control valve is started to move.

The above-described object can also be achieved by providing a hydraulic pressure circuit of an internal combustion engine, comprising: an introduction section through which oil is introduced from a variable capacitance pump configured to vary a drained flow quantity in accordance with a drained pressure of oil; a main passage section communicated with a supply section supplying each slide section of an internal combustion engine; a branch passage branched from the main passage section to supply oil to a hydraulic pressure actuator; and a control valve configured to control an oil flow quantity to the supply section by moving a valve body thereof in accordance with a pressure of the introduction section, wherein a pressure at the introduction section under which the valve body of the control valve is started to move is lower than a pressure under which the drained flow quantity of the variable capacitance pump is started to be varied.

DETAILED DESCRIPTION OF THE INVENTION

Reference will, hereinafter, be made to the drawings in order to facilitate a better understanding of the present invention. Preferred embodiments of an apparatus having a control valve and a variable capacitance pump and a hydraulic circuit of an internal combustion engine in which the apparatus described above having the control valve and variable capacitance pump are used will be described in details with reference to the accompanied drawings.

First Embodiment

In the first preferred embodiment, a valve timing control apparatus which variably controls a valve open-and-closure timing of, for example, an intake valve of an internal combustion engine in accordance with an engine driving condition is used as a hydraulic pressure actuator. As a driving source of the valve timing control apparatus, oil is used which is drained from a variable capacitance pump supplying lubricating oil to each lubricating section of the internal combustion engine.

Figure 1:
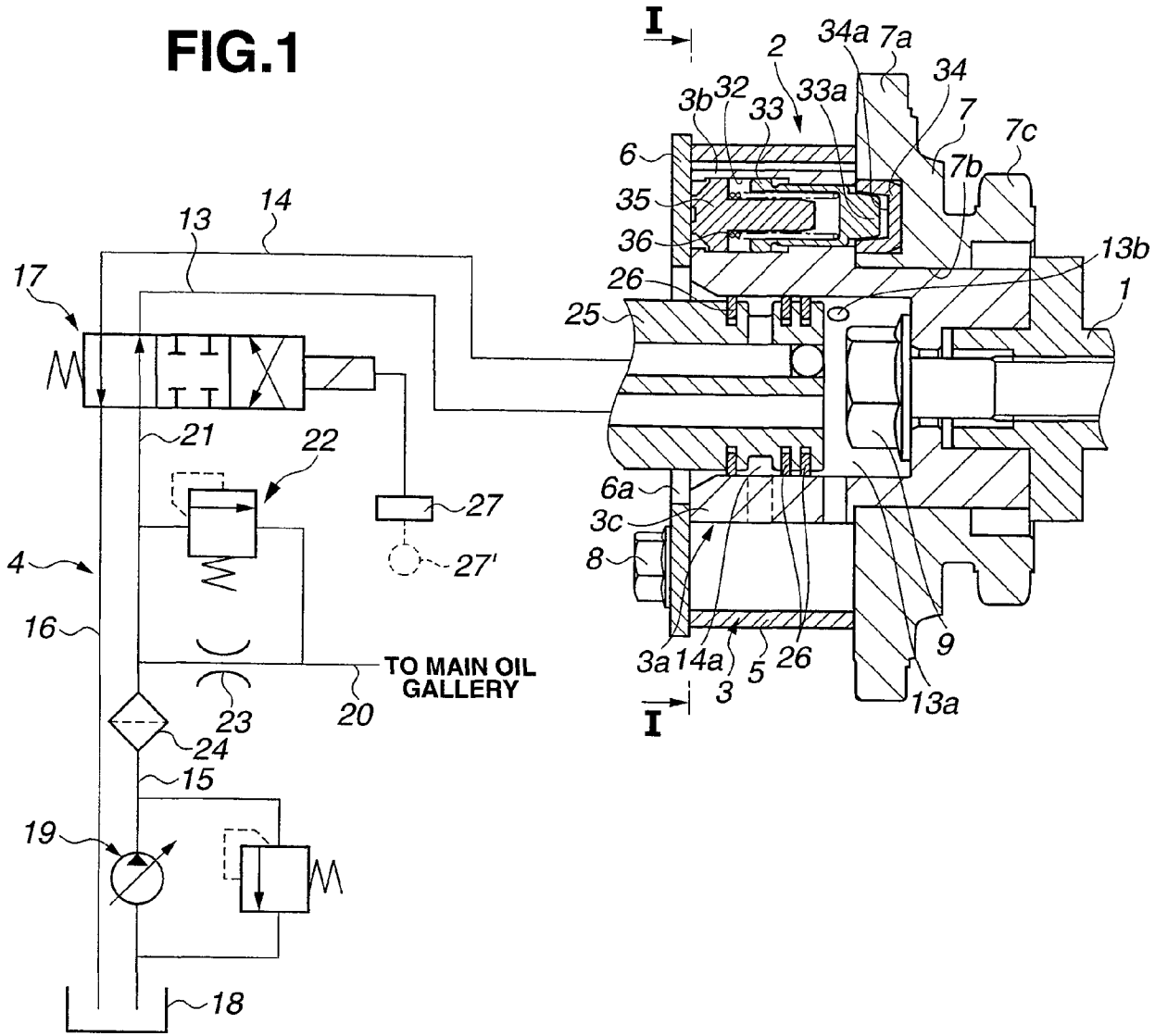
FIG. 1 is a partially cross sectional view representing a valve timing control apparatus to which a control valve according to the present invention is applicable.
Figure 2:
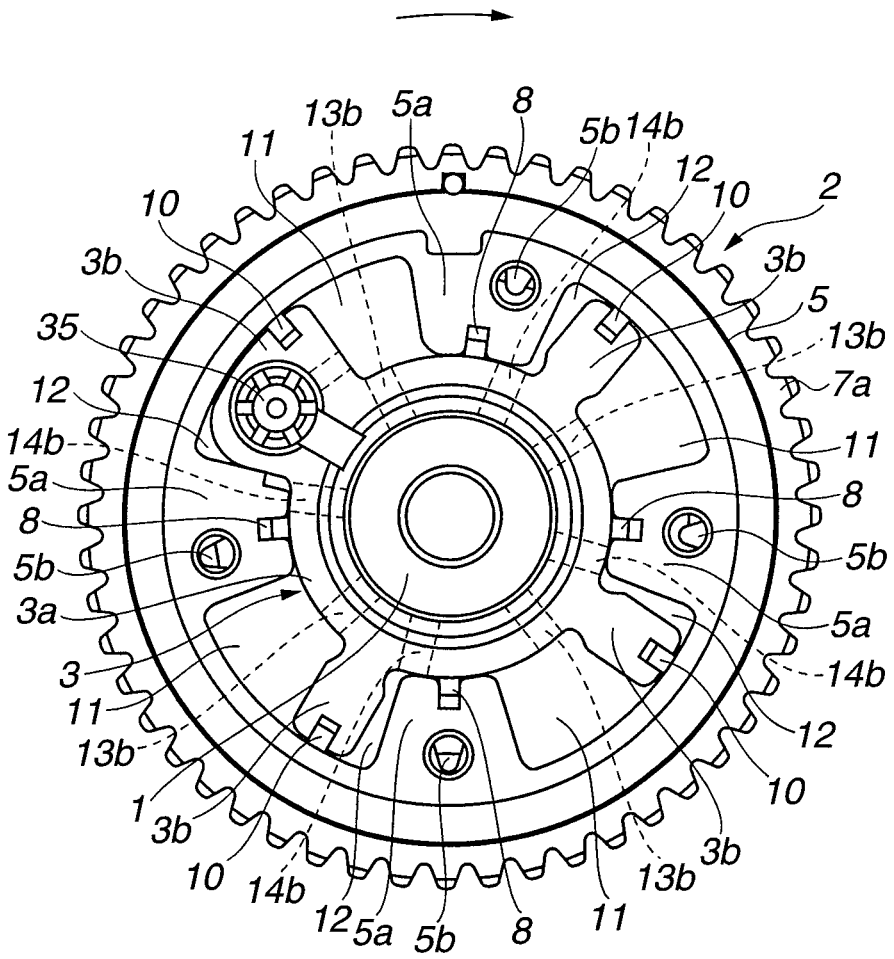
FIG. 2 is a cross sectional view cut away along a line of I-I in FIG. 1 representing a maximum advance angle controlled state by the valve timing control apparatus shown in FIG. 1.
Figure 3:
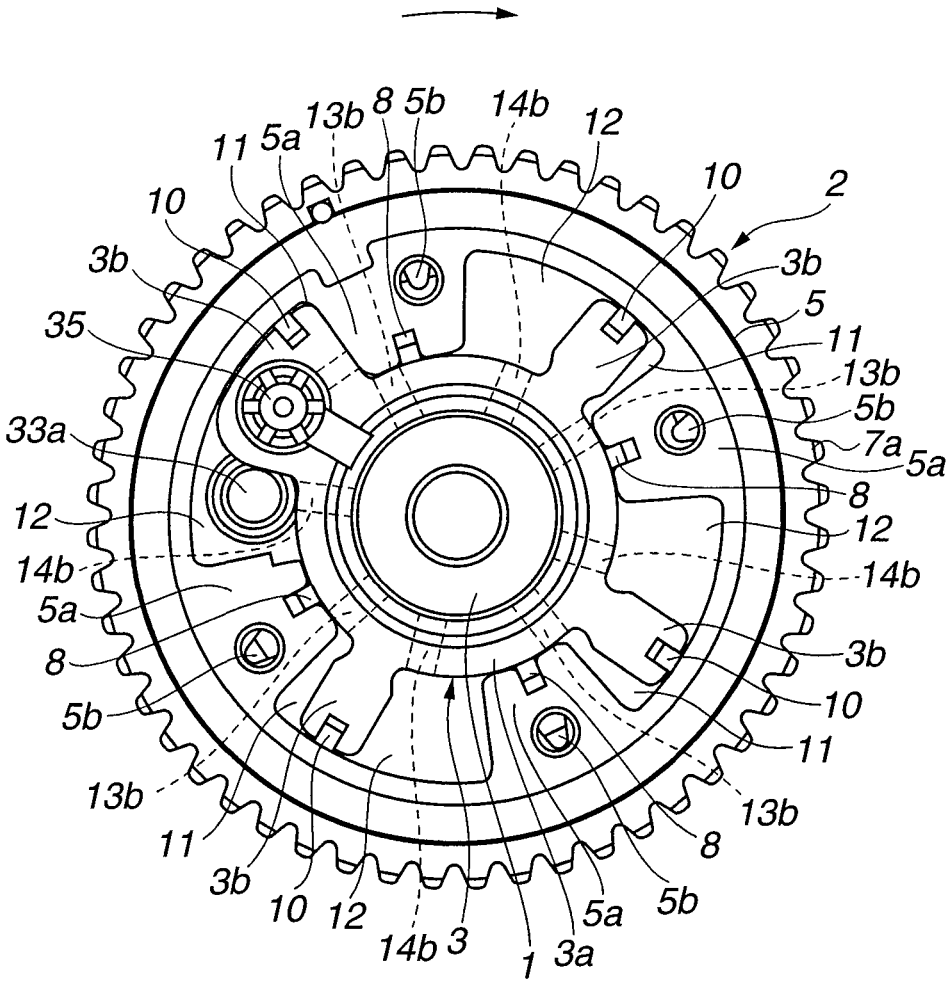
FIG. 3 is a cross sectional view cut away along a line of I-I in FIG. 1 representing a maximum retardation angle controlled state by the valve timing control apparatus shown in FIG. 1.

The above-described valve timing control apparatus is of, so-called, a vane type as shown in FIGS. 1 through 3. A crankshaft of the internal combustion engine causes the valve timing control apparatus to be rotatably driven in an arrow-marked direction as viewed from each of FIGS. 2 and 3. This valve timing control apparatus includes: a timing sprocket 2 whose rotational driving force is transmitted to a camshaft 1; a vane member 3 fixed to the end of camshaft 1 and housed rotatably within timing sprocket 2; and a hydraulic circuit 4 reversely and normally revolving vane member 3 by means of its hydraulic pressure.

Timing sprocket 2 includes: a housing 5 rotatably housing vane member 3 therein; a front cover 6 of a disc-plate like shape closing a front end opening of housing 5; and a rear cover 7 of an approximately disc-plate shape closing the rear end opening of housing 5. Four small-diameter bolts 8 integrally and commonly serve to fix together, from the axial direction of camshaft 1, housing 5, front cover 6, and rear cover 7.

This housing 5 is cylindrical shape and both of front and rear ends thereof are opened and shoes 5*a* which are four partitioning walls, each wall being positioned at an interval of an about 90° position in the peripheral direction of an inner peripheral surface thereof are projected inwardly.

Each shoe 5*a* has an approximately trapezoidal cross sectional surface and has one of four bolt inserting holes 5*b* through which axle sections of respective bolts 8 are inserted and which are penetrated in the axial direction of timing sprocket at a center position thereof. A letter U-shaped seal member 8 and a plate spring (not shown) pressing seal member 8 toward the inner direction are fitted into a holding groove cut out along the axial direction and formed on each of inner end surfaces of each shoe 5*a*.

Front cover 6 is formed in a disc plate-like shape and has its center position into which a relatively large diameter penetrating hole 6*a* is fitted and four bolt holes (not shown) are fitted into an outer peripheral section of front cover 6 at positions corresponding to respective bolt inserting holes 5*b* of respective shoes 5*a*.

Rear cover 7 has its outer peripheral side on which a gear section 7*a* which is meshed with the timing chain is integrally mounted and has an approximately center position on which a large-diameter journal hole 7*b* is penetrated in the axial direction. It should be noted that a gear section 7*c* on which another chain which transmits a power to (vehicular) accessories is wound is integrally mounted at a rear end section thereof.

Vane member 3 includes: an annular vane rotor 3*a* having a bolt inserting hole at a center thereof; and four vanes 3*b* each of four vanes 3*b* being integrally mounted at an approximately 90 degree position in a peripheral direction of an outer peripheral surface of vane rotor 3*a*.

Vane rotor 3*a* has a tip of its small-diameter cylindrical section at the front end side thereof rotatably slid on an inner surface of a proximity to penetrating hole 6*a* of front cover 6 and has a small-diameter cylindrical section at its rear end side which rotatably supports a whole timing sprocket 2 via journal hole 7*b* of rear cover 7.

In addition, vane member 3 is fixed to a front end section of camshaft 1 by means of a cam bolt 9 inserted into a bolt inserting hole of vane rotor 3*a* from its axial direction.

Three of four respective vanes 3*b* are formed in a relatively elongated rectangular parallelepiped shape and the remaining one 3*b* is formed in the trapezoidal shape having a large width of its length is formed. The former three vanes 3*b* described above have the generally same widths with each other and the remaining one of the vanes 3*b* has its width length set to be larger than the other three vanes 3*b*. Consequently, a weight balance of the whole vane member 3 is taken.

Each vane 3*b* is interposed between each shoe 5*a* and a letter U-shaped seal member 10 which is slid on the inner peripheral surface of housing 5 and a plate spring which presses seal member 10 in the direction of the inner peripheral surface of housing 5 are respectively fitted and held onto an elongated holding groove formed in the axial directions of each outer surface of vanes 3*b*.

Furthermore, four retardation angle side hydraulic pressure chambers 11 and four advance angle side hydraulic pressure chambers 12 are partitioned between both sides of respective vanes 3*b* and both side surfaces of respective shoes 5*a*.

Hydraulic pressure circuit 4, as shown in FIG. 1, includes two-channel hydraulic pressure passages of: a first hydraulic pressure passage 13 which supplies and drains the hydraulic pressure of the working oil to and from respective retardation angle side hydraulic pressure chambers; and a second hydraulic pressure passage 14 which supplies and drains the hydraulic pressure of the working oil to and from respective advance angle side hydraulic pressure chambers 12.

Both of first and second hydraulic pressure passages 13 and 14 are connected to supply passage 15 and drain passage 16 respectively via a passage switching electromagnetic switching valve 17.

Variable capacitance pump 19 which supplies the working oil within oil pan 18 under pressure is provided in supply passage 15 and a downstream end of drain passage 16 is communicated to an oil pan 18.

Figure 4:
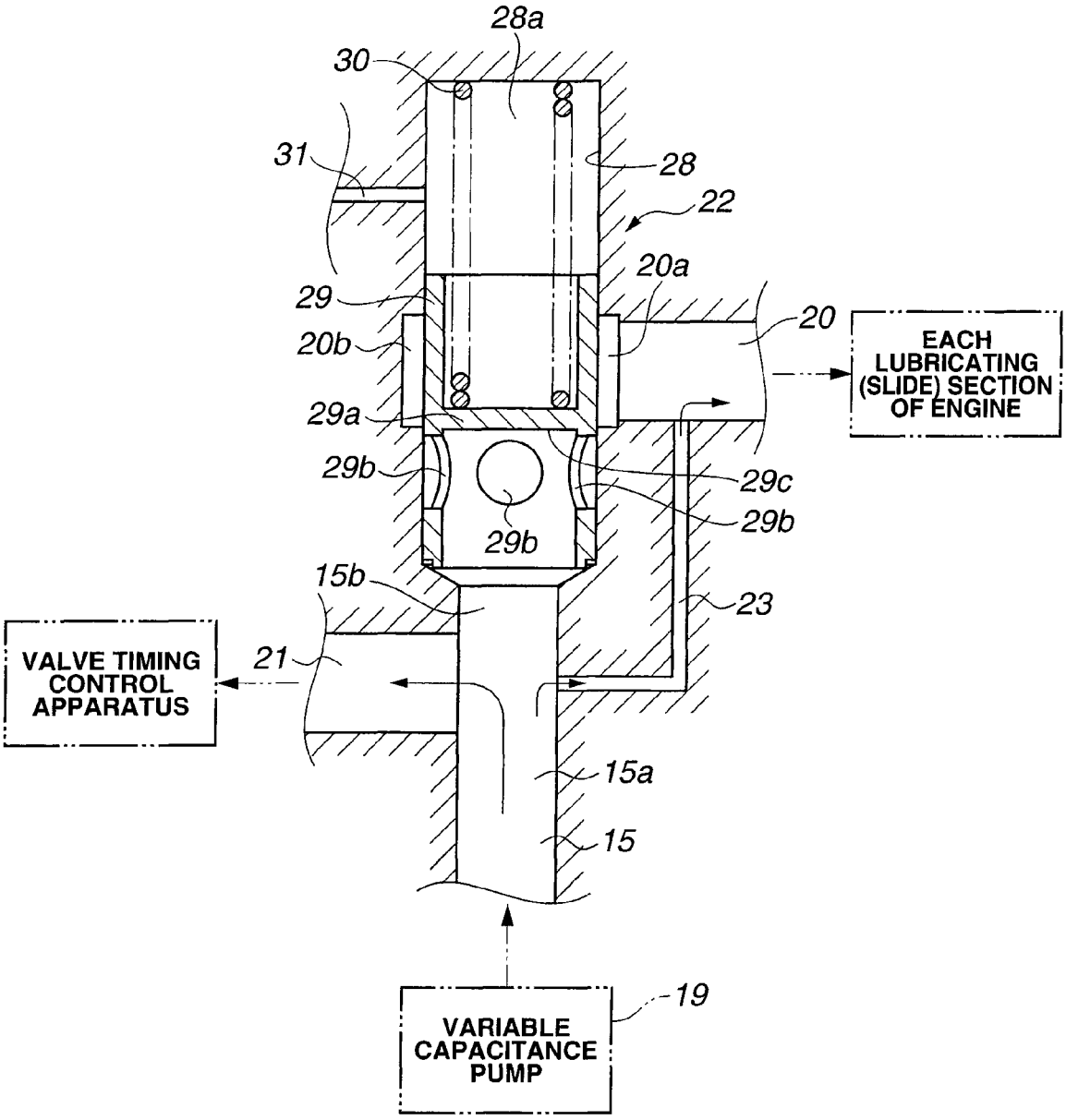
FIG. 4 is a longitudinal cross sectional view of the control valve applicable to a first preferred embodiment of the control valve shown in FIG. 1.
Figure 5:
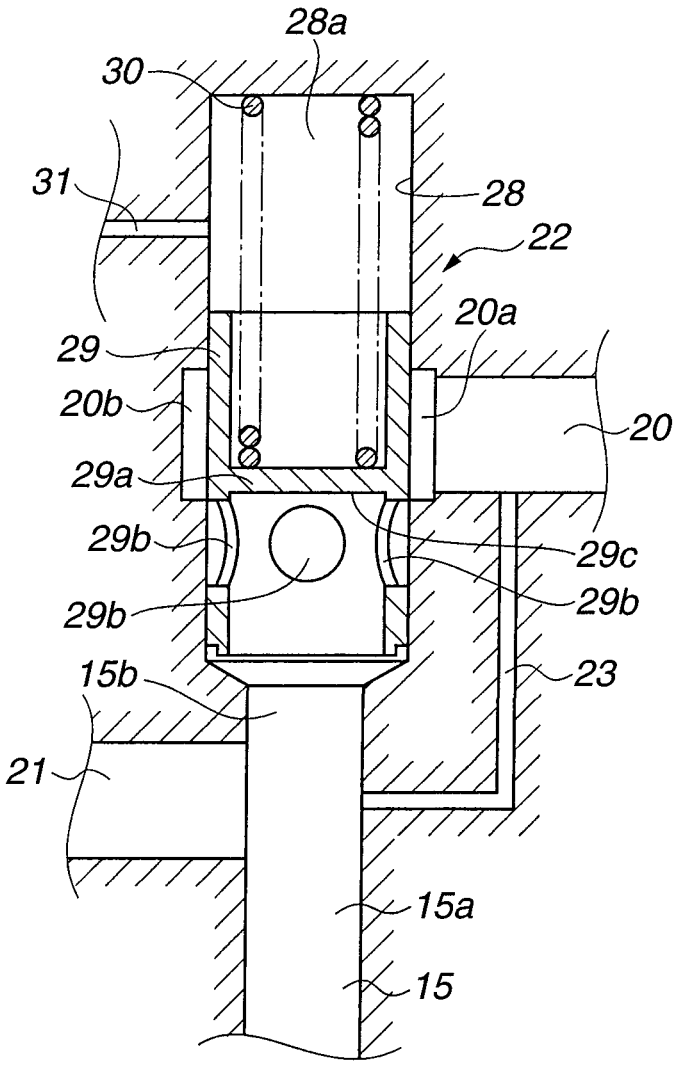
FIG. 5 is a longitudinal cross sectional view representing a state immediately before a communication between a supply passage and a main oil gallery through the same control valve shown in FIG. 4 is established.
Figure 6:
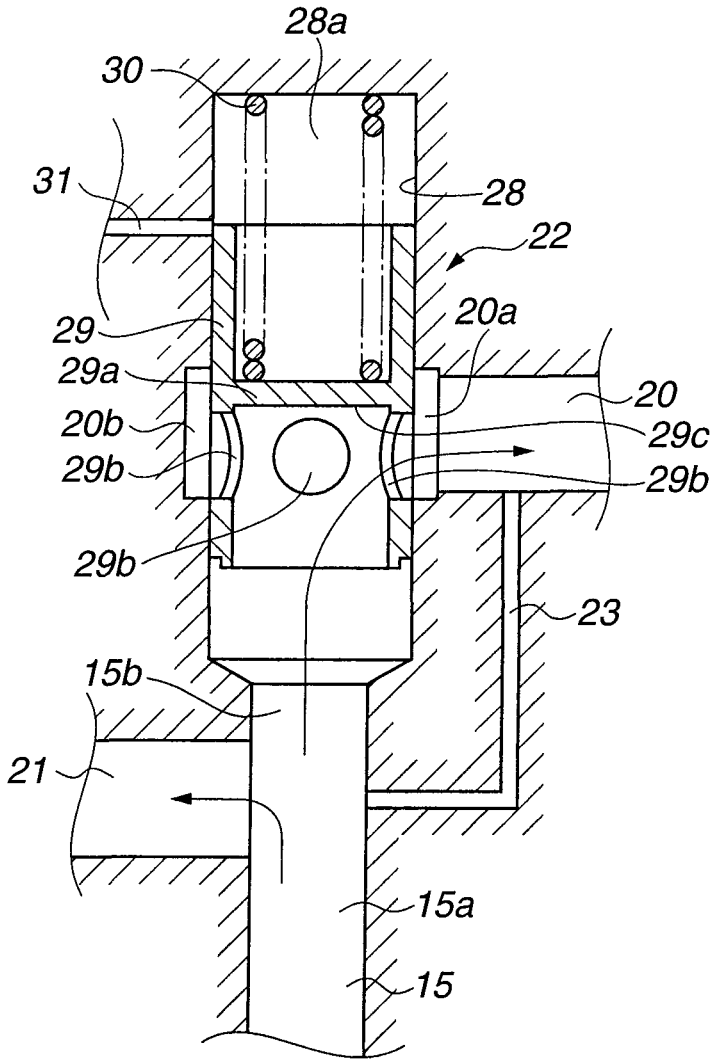
FIG. 6 is a longitudinal cross sectional view representing a state immediately before the communication between the supply passage and the main oil gallery through the same control valve shown in FIG. 4 is established.

Supply passage 15 includes: an introduction section 15*a* and a main passage section 15*b* in a midway through supply passage 15, as shown in FIGS. 4 through 6. A main oil gallery 20 which is a supply section from which lubricating oil (oil) is supplied to each lubricating section of the internal combustion engine is provided at the downstream side of main passage section 15*b*. In addition, a branch passage 21 branched from main passage section 15*b* and through which oil is supplied to respective hydraulic pressure passages 13, 14 via electromagnetic switching valve 17 is connected to main passage section 15*b*.

In addition, control valve 22 is provided between main passage section 15*b* and main oil gallery 20 for controlling an oil supply quantity of main oil gallery 20 in accordance with a draining pressure of variable capacitance pump 19. A small-diameter orifice passage 21 is connected to supply oil of main passage section 15*b* to main oil gallery 20 by bypassing control valve 22 when control valve 22 is closed.

An oil filter 24 is intervened at an upstream side of control valve 22 of main passage section 15*b* which collects dust or so on of oil caused to flow into control valve 22.

First and second hydraulic pressure passages 13, 14 are formed at an inner section of a column shaped passage constituting section 25 and this column shaped passage constituting section 25 has its one end inserted through a cylindrical section 3*c* of vane rotor 3*a* via penetrating hole 6*a* of front cover 6. On the other hand, the other end of passage constituting section 25 connected to electromagnetic switching valve 17.

In addition, three annular shield members 26 are fitted and inserted between an outer peripheral surface of one end section of passage constituting section 25 and an inner peripheral surface of cylindrical section 3*c* via penetrating hole 6*a* of front cover 6 and, on the other hand, is connected to electromagnetic switching valve 17.

First hydraulic pressure passage 13 includes: an oil chamber 13*a* formed at one end faced against camshaft 1 of cylindrical section 3*c*; and four branch passages 13*b* communicating between oil chamber 13*a* and retardation angle side hydraulic pressure chambers 11, as shown in FIG. 1. Four branch passages 13*b* are approximately radially formed in the inside of vane rotor 3*a*.

On the other hand, second hydraulic pressure passage 14 includes: an annular chamber 14*a* formed at one end section of passage constituting section 25 and formed on an outer peripheral surface of the one end section thereof: and a second oil passage 14*b* formed on the inside of vane rotor 3*a* by folding it in an approximately letter L shape to communicate between annular chamber 14*a* and respective advance angle side hydraulic pressure chambers 12.

Electromagnetic switching valve 17 is of four-port and three-position type and has an inner valve body controllably and relatively switched between respective hydraulic pressure passages 13, 14 and supply passage 15 and drain passage 16. In addition, a control signal from a controller 27 causes electromagnetic switching valve 17 to be operatively switched.

This electromagnetic switching valve 17, in a case where a control current is not acted upon this electromagnetic switching valve 17, communicates supply passage 15 with first hydraulic pressure passage 13 communicated with respective retardation angle side hydraulic pressure chambers 11 and communicates drain passage 16 with second hydraulic pressure passages 14 communicated with respective retardation angle side hydraulic pressure chambers 12. In addition, coil springs within electromagnetic switching valve 17 serve to mechanically form the above-described positions This controller 27 detects an engine driving state in response to the information signal from various types of sensors such as a crank angle sensor and an airflow meter, detects a relative revolutional position between a timing sprocket 2 and camshaft 1 in response to signals from the crank angle sensor and a camshaft angle sensor, and outputs the control current to electromagnetic switching valve 17.

Control valve 22 is, as shown in FIGS. 4 through 6, is mainly provided with a column shaped (or cylindrical) valve hole 28 fitted into an inner side of the cylinder block of the internal combustion engine and formed at the downstream side of main passage section 15*b*; an approximately cylindrical valve body 29 slidably disposed within the inner side of valve hole 28; and a valve spring 30 which is a biasing member to bias valve body 29 in a closure direction.

Valve hole 28 has its tip communicated with main passage section 15*b* from the axial direction and, at its approximately center position in the axial direction, one end opening 20*a* of main oil gallery 20 is exposed thereto. This end opening 20*a* is communicated with valve hole 28 via a doughnut shaped groove 20*b* formed on a surrounding of valve hole 28.

A disc-plate shaped partitioning wall 29*a* is integrally mounted on valve body 29 at an approximately center position of the axial direction of valve body 29. A plurality of opening holes 29*b* are penetrated and formed at the tip end of the peripheral wall at the main passage section 15*b* along the diameter direction of valve body 29. Each opening hole 29*b* is communicated with doughnut shaped groove 20*b* in accordance with the slide position of valve body 29. In addition, a lower end surface of partitioning wall 29*a* is constituted as a first pressure receiving surface 29*c* receiving the hydraulic pressure introduced from main passage section 15*b*.

Valve spring 30 is provided with its upper end elastically contacted on a bottom surface of valve hole 28 and its lower end elastically contacted on an upper surface of partitioning wall 29*a*. If the hydraulic pressure within main passage section 15*b* is equal to or lower than a predetermined pressure, the spring force of valve spring 30 causes valve body 29 to be biased toward the lower direction to interrupt the communication between opening hole 29*b* and doughnut shaped groove 20*b*, namely, closely stops doughnut shaped groove 20*b* at a part of a peripheral wall more upper end section than partitioning wall 29*a* of valve body 29.

In addition, a housing chamber 28 in which valve spring 30 placed at the rear end section of valve body 28 is communicated with an external via an air vent hole 31, thus securing a favorable slide characteristic for valve body 29.

When oil drained from variable capacitance pump 19 into supply passage 15 is acted as a pressure upon first pressure receiving surface 29*c* of valve body 29 from main passage section 15*b* and the pressure becomes larger than a set weight of valve spring 30, valve body 29 is retracted so that opening hole 29*b* is communicated with respective opening holes 20*b* (refer to FIG. 6). Thus, the drainage oil within supply passage 15 is supplied to main oil gallery 20 via valve body 29.

It should be noted that oil drained into supply passage 15 is, at all times, directly supplied as an operation purpose of the valve timing control apparatus via branch passage 21.

In addition, a lock mechanism is interposed between vane member 3 and housing 5 to constrain and to release the constraint of vane member 3 with respect to housing 5.

This lock mechanism, as shown in FIG. 1, includes: a slide hole 32 interposed between one vane 3*b* having a large width in length and rear cover 7 and formed along the axial direction of camshaft 1 at an inside of vane 3*b*; a lock pin 33 in a bottomed cylindrical shape slidably installed at an inside of slide hole 32; an engagement hole 34*a* from which a tapered tip section 33*a* of lock pin 33 engageably disengaged and installed on an engagement constituting section 34 of a cup shape in cross section fixed within a fixture hole provided on rear cover 7; and a spring member 36 which biases lock pin 33 toward engagement hole direction 34*a* retained on a spring retainer 35 fixed on a bottom side of slide hole 32.

In addition, either the hydraulic pressure within retardation angle side chamber 11 or that within variable capacitance pump 19 is directly supplied to engagement hole 34*a* via an oil hole (not shown).

Then, lock pin 33 locks a relative revolution between timing sprocket 2 and camshaft 1 when tapered tip section 33*a* is engaged with engagement hole 34*a* according to the spring force by spring member 36 at a position at which vane member 3 is revolved at a most retardation angle side. In addition, lock pin 33 is retracted so that lock pin 33 releases the engagement with engagement hole 34*a* according to the hydraulic pressure supplied from retardation angle side hydraulic pressure chamber 11 within engagement hole 34*a* or the hydraulic pressure of variable capacitance pump 19.

Hereinafter, a basic operation of the valve timing control apparatus described above will be described. First, when the engine is stopped, an output of the control current to electromagnetic switching valve 17 from controller 27 is stopped so that supply passage 15 is communicated with first hydraulic pressure passage 13 at the retardation angle side and drain passage 16 is communicated with second hydraulic pressure passage side 14. In addition, in a state in which the engine is stopped, the hydraulic pressure of variable capacitance pump 19 is not acted and the supply hydraulic pressure is made zero.

Hence, when vane member 3 is revolved toward the retardation angle side by means of an alternating torque acted upon camshaft 1 at a time of the engine stop, one end surface of one largely wide vane 3*b* is contacted with one side surface of opposing single shoe 5*a* and, at the same time, a tip section 33*a* of lock pin 33 of the lock mechanism is engaged with engagement hole 34*a*. Thus, vane member 3 is stably held at a position which achieves the most retardation angle position. That is to say, the most retardation angle side position provides a default position at which the valve timing control apparatus is mechanically stable. This default position provides a position at which the engine can be started.

It should herein be noted that the default position is a mechanically and automatically stable position when an non-operation is carried out, namely, in a case where the control signal is not issued.

Next, when the engine is started, namely, when an ignition switch is turned on so that a starter motor is rotatably driven and the crankshaft is cranked (cranking rotation), the control signal is issued from controller 27 to electromagnetic switching valve 17. Thus, electromagnetic switching valve 17 communicates between supply passage 15 with first hydraulic pressure passage 15 and communicates between drain passage 16 and second hydraulic pressure passage 14.

Then, oil is supplied to respective retardation angle side hydraulic chambers 11 via first hydraulic pressure passage 13 together with a rise in the hydraulic pressure supplied under pressure from variable capacitance pump 19 and the hydraulic pressure is not supplied to respective advance angle side hydraulic pressure chambers 12 in the same way as during the engine stop and the hydraulic pressure is released into oil pan 18 from drain passage 16 to maintain a low pressure state.

After the hydraulic pressure at respective retardation angle side hydraulic pressure chambers 11 is raised, electromagnetic switching valve 17 can freely perform a position control for vane member 3. That is to say, the hydraulic pressure within engagement hole 43*a* of the lock mechanism is raised together with the rise in the hydraulic pressure of respective retardation angle side hydraulic pressure chambers 11. At this time, lock pin 33 is retracted. Then, tip portion 33*a* is drawn from engagement hole 43*a* and the relative revolution of vane member 3 to housing 5 is allowed to enable an universal vane position control.

Hence, when, thereafter, the engine is transferred into, for example, a predetermined low-revolution-and-middle-load region, the control signal from controller 27 is issued to operate electromagnetic switching valve 17 to make communication between supply passage 15 to second hydraulic pressure passage 14 and to make communication between drain passage 16 and first hydraulic pressure passage 13.

Hence, at this time, the hydraulic pressure within respective retardation angle side hydraulic pressure chambers 11 is returned from drain passage 16 within oil pan 18 via first hydraulic pressure passage 13 so that the hydraulic pressure within respective retardation angle side hydraulic pressure chambers 11 is under a low pressure and, on the other hand, the hydraulic pressure is supplied to respective advance angle side hydraulic pressure chambers 12. Thus, the pressure within respective advance angle side hydraulic pressure chambers 12 becomes high.

Thus, vane member 3 is relatively revolved in the clockwise direction as viewed from the drawings at a position shown in FIG. 3 due to the high pressurization within respective advance angle side hydraulic pressure chambers 12. A relative revolution phase of camshaft 1 with respect to timing sprocket 2 is converted to a most advance angle side. In addition, the position of electromagnetic switching valve 17 is used as a neutral position so that an arbitrary relative revolution phase can be held.

Furthermore, when the engine is transferred from the low revolution region of the engine to an ordinary middle revolution region thereof, the same control as the engine start time is performed. Thus, vane member 3 converts the relative revolution phase of timing sprocket 2 and camshaft 1 to the retardation angle side by the reduction in the hydraulic pressure supplied to respective advance angle side hydraulic pressure chambers 12 and the rise in the hydraulic pressure of respective retardation angle side hydraulic pressure chambers 11 (refer to FIG. 2).

Variable capacitance pump 19, as shown in FIGS. 7 through 11, includes: a pump housing 41 provided at a front end portion of the cylinder block of the engine in a bottomed cylindrical shape having an end opening enclosed by a cover 42; a drive shaft 43 which is penetrated through an approximately center portion of pump housing 41 and is rotatably driven by a crankshaft of the engine; a rotor 44 of an approximately letter H shape in cross section rotatably housed within the inside of pump housing 41 and having the center portion coupled to drive shaft 43; a cam ring 45 which is a movable member slidably disposed on an outer peripheral side of rotor 44; and a small-diameter pair of vane rings 46, 46 slidably disposed on both side surfaces of inner peripheral sides of rotor 44.

Figure 9:
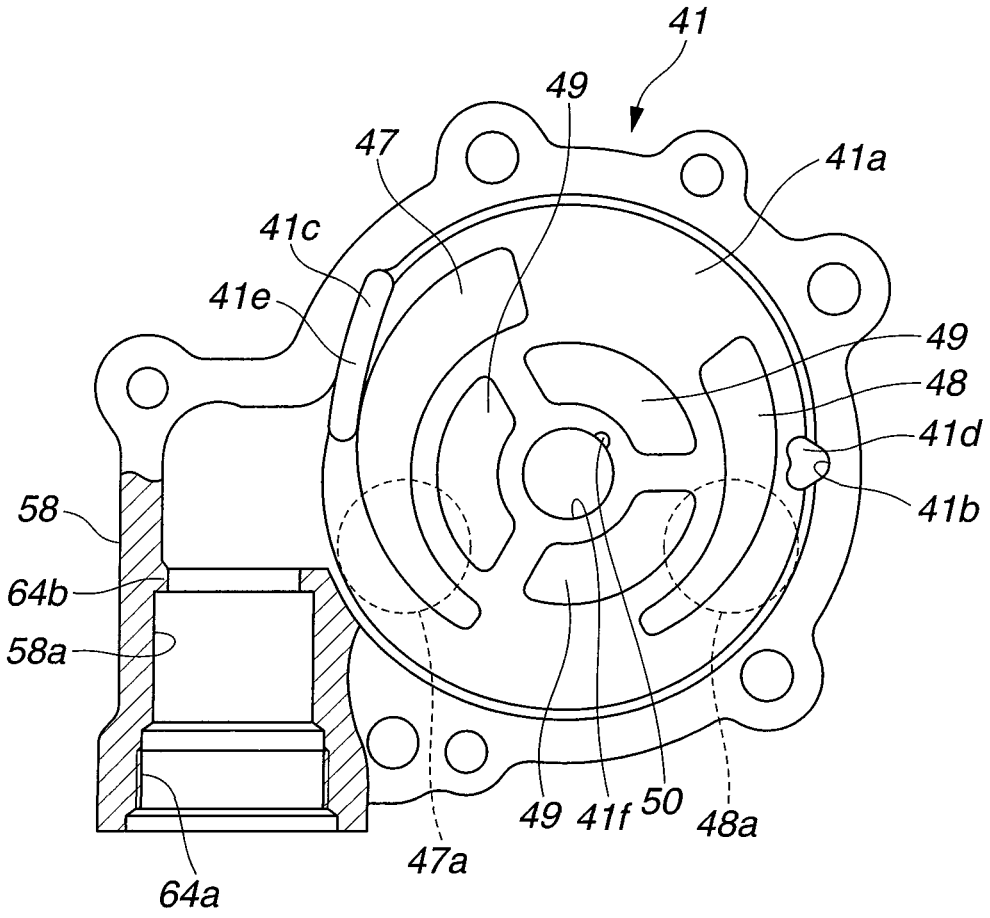
FIG. 9 is a front view representing a pump housing of the variable capacitance pump shown in FIG. 7.

Pump housing 41 is integrally formed of an aluminum-base alloy. As shown in FIG. 9, a recess shaped bottom surface 41*a* thereof is processed with high flatness and high surface roughness since bottom surface 41*a* is slid by one side surface of cam ring 45. In addition, a slide range is formed through machining. A receiving seat 41*b* in an approximately arc recess groove shape which provides a fulcrum point of cam ring 45 is formed at a predetermined position of an inner peripheral surface of pump housing 41. A seal sliding surface 41*c* on which seal member 54 of cam ring 45 as will be described later is slid is formed at a position approximately opposing against receiving seat 41*b* via housing 41. This seal sliding surface 41*c* is of an arc surface shape formed by a radius with receiving seat 41*b* as a center.

Since receiving seat 41*b* and seal sliding surface 41*c* are formed in curved surface shapes, each of these parts 41*b*, 41*c* having small R (radius of curvature), only these parts are processed with a relatively small tool to shorten a processing time. In addition, when receiving seat 41*b* and seal sliding surface 41*c* are processed, an approximately heart shaped minute recess portion 41*d* and elongated minute recess portion 41 are formed as processed marks. The presence of these minute recess portions 41*d*, 41*e* does not obstruct the slide movement of cam ring 45.

An approximately crescent-shaped suction port 47 is formed on a left side of seal sliding section 41*c* of bottom surface 41*a* of pump housing 41 and a drain port 48 of an approximately crescent-shaped suction port is formed on a right half of receiving seat 41*b* is formed o as to face against each other.

Suction port 47 is communicated with a suction opening 47*a* through which the lubricating oil within the oil pan is sucked and drain port 48 is communicated with oil main gallery 20 and branch passage 21 via supply passage 15 described before from a drain opening 48*a*. Three oil reservoirs 49 which once reserve the lubricating oil drained from drain port 48 are formed at the equal interval positions in the circumferential direction thereof on an outer peripheral side of bearing hole 41*f* of drive shaft 43 formed at the center of bottom surface 41*a*. The lubricating oil is supplied to bearing hole 41*f* via a bearing supply groove 50 and the lubricating oil is supplied to both side surfaces of rotor 44 and the side surface of vane 51 as will be described later to secure a lubricating performance.

It should be noted that the inner surface of above-described cover 42 is formed on a flat surface in this embodiment but suction opening, drain opening, and oil reservoirs may be formed on this inner surface in the same way as bottom surface 41*a*. It should also be noted that this cover 42 is attached onto pump housing 41 by means of a plurality of bolts BB.

Figure 7:
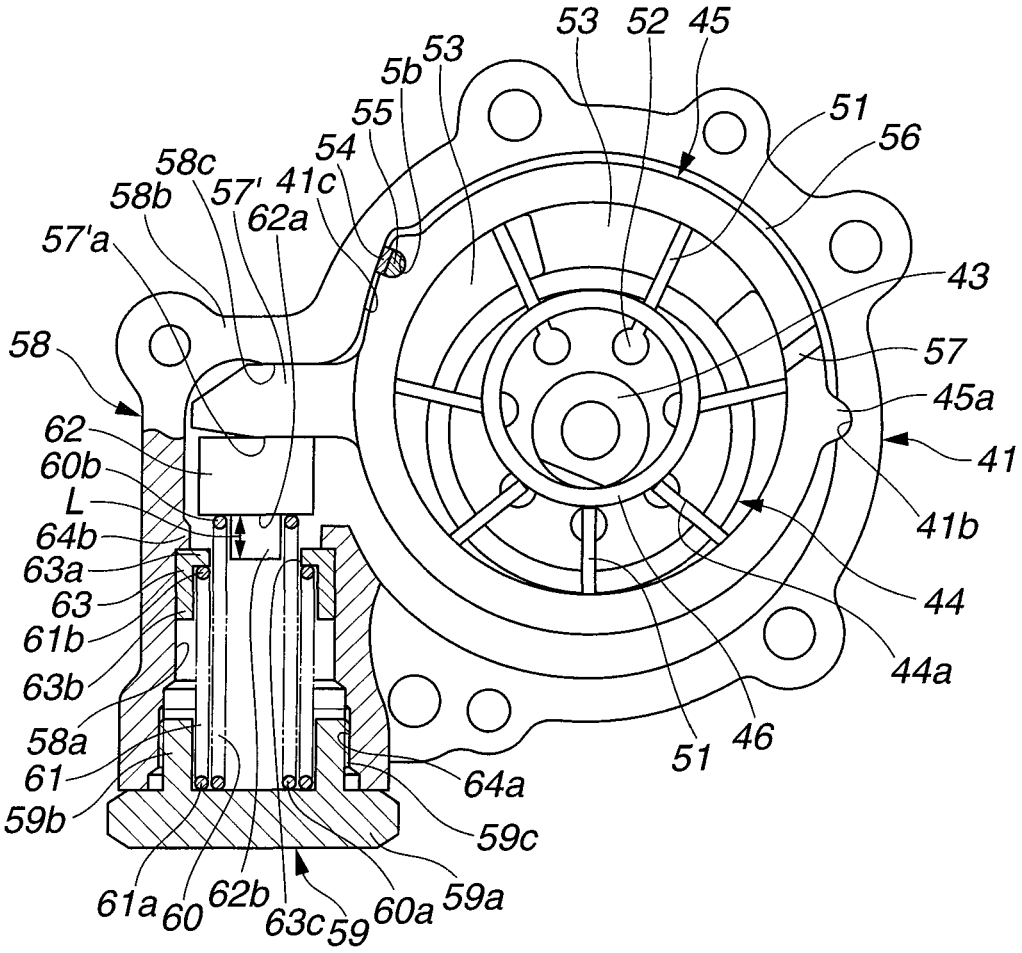
FIG. 7 is a cross sectional view of a variable capacitance pump applicable to the first embodiment of the control valve shown in FIG. 1.

Above-described drive shaft 43 serves to revolve rotor 41 in the clockwise direction with respect to FIG. 7 by means of a rotational force transmitted from the crankshaft. In FIG. 7, a left half portion indicates a suction stroke and a right half portion indicates a drain stroke.

Figure 8:
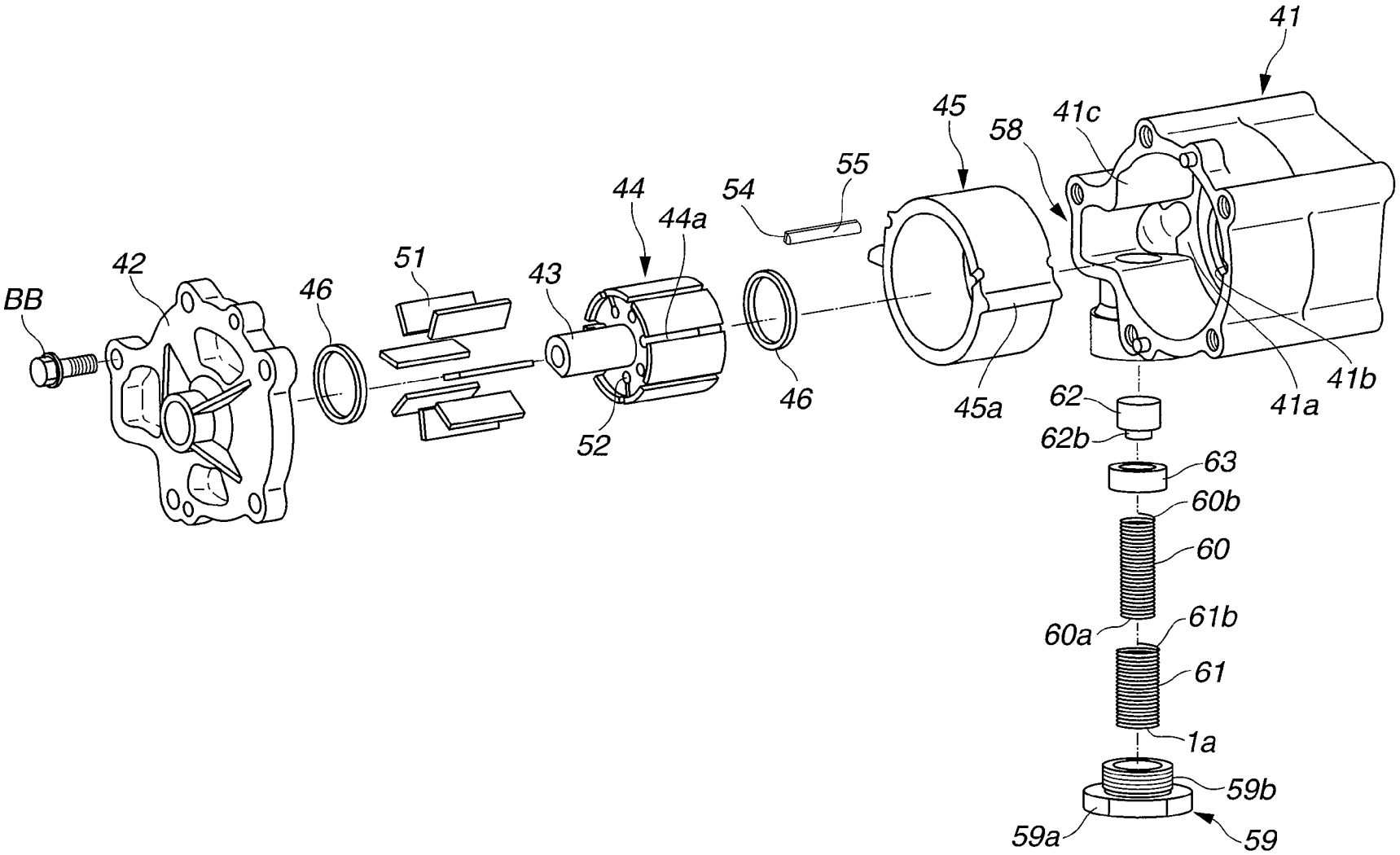
FIG. 8 is an exploded perspective view of the variable capacitance pump shown in FIG. 7.

Above-described rotor 44 has a plurality of vanes 51 retractably and slidably held within a plurality of slots 44*a* formed radially from an inner center side toward an outside, as appreciated from FIGS. 7 and 8. A back pressure chamber 52 in an approximately circular shape of cross section which introduces a drained hydraulic pressure drained into drain port 48 is formed on an inner basic end section of each slot 44*a*.

Each vane 51 has a basic end section slidably contacted on an outer peripheral surface of a vane ring 46 and has a tip section slidably contacted on an inner peripheral surface 45*a* of cam ring 45. A plurality of pump chambers 53 which are a plurality of working oil chambers are formed in a manner of liquid tightness between each vane 51 and between the inner peripheral surface of cam ring 45, an inner peripheral surface of rotor 44, bottom surface 41*a* of pump housing 41, and an inner end surface of cover 42. Each vane ring 46 pushes out each vane 51 radially in the outward direction.

Above-described cam ring 45 is integrally formed approximately in the cylindrical shape by an sintered metal of an easy machining capability. A pivot section 45*a* of an approximately arc-shaped convex shape is integrally formed along the axial direction at a predetermined position of the outer peripheral surface of cam ring 45. Pivot section 45*a* is fitted into receiving seat 41*b* of pump housing 41 to provide an eccentric swing fulcrum. A seal member 54 is provided at a position approximately opposite to pivot section 45*a* which is slidably contacted on seal sliding surface 41*c* at a time of an eccentric swing.

This seal member 54 is formed of, for example, a synthetic resin material having a low wear-out characteristic like an elongated rod along the axial direction of cam ring 45 and is pressed toward a forward direction, namely, toward a seal slide surface 45*b*, by means of an elastic force of a rubber made elastic member 56 fixed within a holding groove 45*b* cut out in an arc shape (refer to FIG. 8). This secures a preferable liquid tightness (or liquid seal) characteristic at all times for a control oil chamber as will be described later.

In addition, approximately crescent-shaped control oil chamber 56 is formed between the outer peripheral surface of pump housing 41, pivot section 45*a*, seal member 54, and the inner peripheral surface of pump housing 41. In addition, an introduction passage 57 is formed on a front end surface of cam ring 45 which introduces the hydraulic pressure drained from drain port 48 into control oil chamber 56. Control oil chamber 56 causes cam ring 45 to be swung according to the drained hydraulic pressure introduced from introduction passage 57 in the counterclockwise direction with pivot section 45*a* as a fulcrum. Thus, an eccentricity of cam ring 45 with respect to rotor 44 is reduced and cam ring 45 is caused to be moved in a concentric direction. It should be noted that introduction passage 57 may not be formed on the front end surface of cam ring 45 but may be formed by penetrating through a peripheral wall.

In addition, an arm 57' projected toward a radial outside is integrally provided on cam ring 45 at a position of cam ring 45 opposite to pivot section 45*a* at the outer peripheral surface of cam ring 45. A lower surface 57'*a* at a tip side of this arm 57' is formed in an arc shape.

It should be noted that pump housing 41, drive shaft 43, rotor 41, cam ring 45, suction port 47, drain port 48, vane 51, and so forth constitute a pump constituting body.

On the other hand, biasing means (a biasing section) for, at all times, biasing cam ring 45 via arm 57' in a direction of providing a maximum eccentricity for cam ring 45 is provided at a position of pump housing 41 symmetrically opposite to pivot section 45*a*.

This biasing means is mainly constituted by: a lidded cylindrical cylinder body 58 made of aluminum-based alloy and integrally formed with pump housing 41; a plug 59 enclosing a lower end opening of cylinder body 58; an inner side first coil spring 60 and an outer side second coil spring 61 which are outside and inside double compression spring members housed in parallel to each other within an inside of cylinder body 58; a first plunger 61 which is a pressing member disposed between a tip of first coil spring 60 and a lower surface 57*a* of arm 57; and a second plunger 63 which is a contacting member disposed on a tip side of second coil spring 61 and slidably guided to an inner peripheral surface 58*a* of cylinder body 58.

Above-described cylinder body 58 has an inner peripheral surface 58*a* formed to provide progressive three stages of diameter reduction structure as inner peripheral surface 58*a* advances from a lower opening side toward an upward direction. A female screw 64*a* on which a male screw formed on an outer periphery of plug 59 is formed on an inner peripheral surface of a largest-diameter lower end opening of inner peripheral surface 58*a*. An annular stopper projection section 64*b* on which an outer peripheral edge of second plunger 63 is brought in close contact is formed on a boundary section between a middle diameter section and a smallest diameter section located over the upward portion of female screw 64*a*. In addition, cylinder body 58 limits a maximum eccentric position of cam ring 45 by a contact of an upper surface of arm 57' against a lower surface 58*c* of an upper end wall 58*b* of cylinder body 58 when arm 57' is pivoted toward the clockwise direction in FIG. 7 according to spring forces of first and second coil springs 60, 61.

Above-described plug 59 includes: an approximately disc-shaped lid section 59*a* located at the bottom side of the biasing means; and a cylinder section 59*b* disposed integrally on the upper surface of lid section 59*a* and exposed from the lower end opening of cylinder body 58 to an inside of cylinder body 58. A male screw 59*c* is formed on an outer periphery of cylinder section 59*b* and a length of engagement between male screw 59*c* and female screw 64*a* can be adjusted. A maximum length of engagement therebetween is limited at a position at which an upper surface of the outer peripheral section of lid section 59*a* is brought in contact with a hole edge of the lower end opening of cylinder body 58.

Above-described first coil spring 60 has its coil diameter smaller than that of second coil spring 61 and is disposed at a more inner side than second coil spring 61. First coil spring 60 has its axial length longer than second coil spring 61. A lower end section 60*a* is elastically contacted on the upper surface of lid section 59*a*. An upper end section 60*b* is elastically contacted on the lower surface of first plunger 62 to have a predetermined spring set weight W1. This spring set weight W1 corresponds to a weight (load) at which cam ring 45 is started to move when hydraulic pressure is P3.

First plunger 62 is formed in a solid cylindrical shape having a flat upper surface which is, at all times, contacted on lower surface 57'*a* of arm 57' and has a lower surface center position on which a small-diameter cylindrical projection section 62*b* is integrally formed. Upper end section 60*b* which is one end section of first coil spring 60 is fitted and held on this projection section 62*b*. Its axial length L of projection section 62*b* is extended up to a position at which a portion of axial length L penetrates through a spring inserting hole 63*c* at an upper wall 63*a* of second plunger 63. This suppresses an inclination (or falling down) or twist of first coil spring 60 at the time of compressive and elongation deformation so as to secure a smooth deformation of first coil spring 60 at all times. It should be noted that first plunger 62 may be of a hollow shape to reduce a weight.

Second coil spring 61 has its lower end section 61*a* elastically contacted on the upper surface of lid section 59*a* and has its upper end section 61*b* elastically contacted on an outer peripheral section of a lower surface of the upper wall of second plunger 63. Second coil spring 61 is also set to a predetermined set weight W2. This set weight W2 is set to a weight (load) at which second plunger 63 is started to move when the hydraulic pressure is P4. it should be noted that the inner diameter of second coil spring 61 is set to a magnitude at which mutual free compression and elongation deformations are possible without contact of an outer peripheral surface of first coil spring 60 on the inner peripheral surface of second coil spring 61 even if first coil spring 60 is compressively deformed.

It should be noted that winding directions of first coil spring 60 and second coil spring 61 are mutually opposite to each other. Hence, first coil spring 60 and second coil spring 61 are not mutually meshed with each other during the compressive and elongation deformations of both of the first and second coil springs 60, 61 and achieve smooth deformations thereof at all times.

Second plunger 63 is formed in a letter-L shape in a longitudinal cross section (refer to FIG. 7), made of an iron-series metallic member, and includes an upper wall 63*a* in a cylindrical shape and cylindrical section 63*b* extended vertically from a lower end edge of the outer periphery of upper wall 63*a* in a downward direction (as viewed from FIG. 7). Spring inserting hole 63*c* through which second coil spring 61 is penetrated is penetrated and formed at a center of upper wall 63*a*. This spring inserting hole 63*c* has the inner diameter having a magnitude (dimension) at which spring inserting hole 63*c* is not contacted on the outer peripheral surface of first coil spring 60 even in a case where first coil spring 60 is compressively deformed and which is set to be smaller than the outer diameter of first plunger 62. Hence, when arm 57' of cam ring 45 causes first plunger 62 to be pressed downward and the first plunger 62 is moved downward to a predetermined position, the outer periphery of lower surface 62*a* of first plunger 62 is contacted on the upper surface outer periphery of upper wall 63*a*.

In addition, although second plunger 63 is moved in the upward and downward directions while being slidably guided within the middle-diameter section of inner peripheral surface 58*a* of cylinder body 58, the contact of outer peripheral edge of upper wall 63*a* on stopper projection section 64*b* limits a maximum upper movement position of second plunger 63.

It should be noted that if an adjustment member such as spacers having different thicknesses is appropriately and selectively interposed between lid section 59*a* of plug 59 and lower end opening edge of cylinder body 58 to adjust the length of engagement described above, a free modification of the spring forces of first and second coil springs 60, 61 is possible.

A volumetric change of each pump chamber 53 is obtained in accordance with the eccentricity of cam ring 45 which is varied according to a relative pressure between each spring force of first and second coil springs 60, 61 and the drained hydraulic pressure within control oil chamber 56 so that the hydraulic pressure drained into drain port 48 via each pump chamber 53 from suction port 47 is varied.

It should be noted that cam ring 45, vane rings 46, 46, control oil chamber 56, the biasing means, and so forth constitute a variable mechanism.

Figure 12:
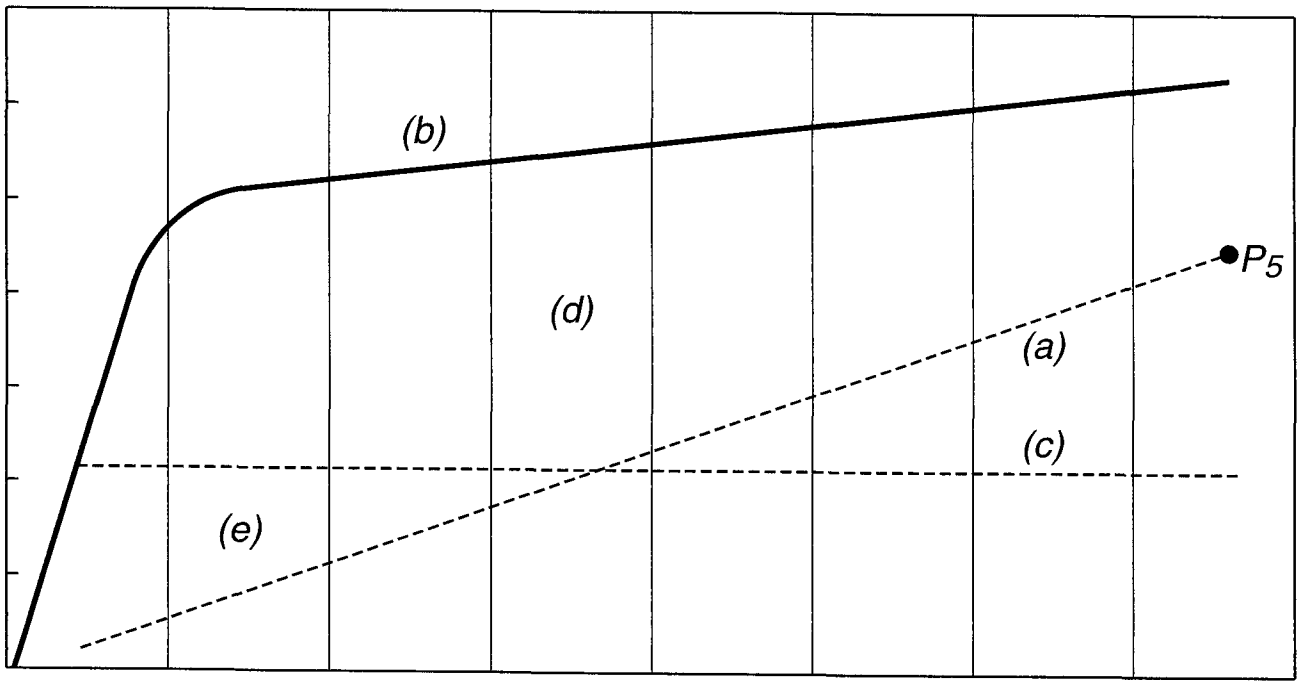
FIG. 12 is a hydraulic pressure characteristic graph in a comparative example of the variable capacitance pump.
Figure 13:
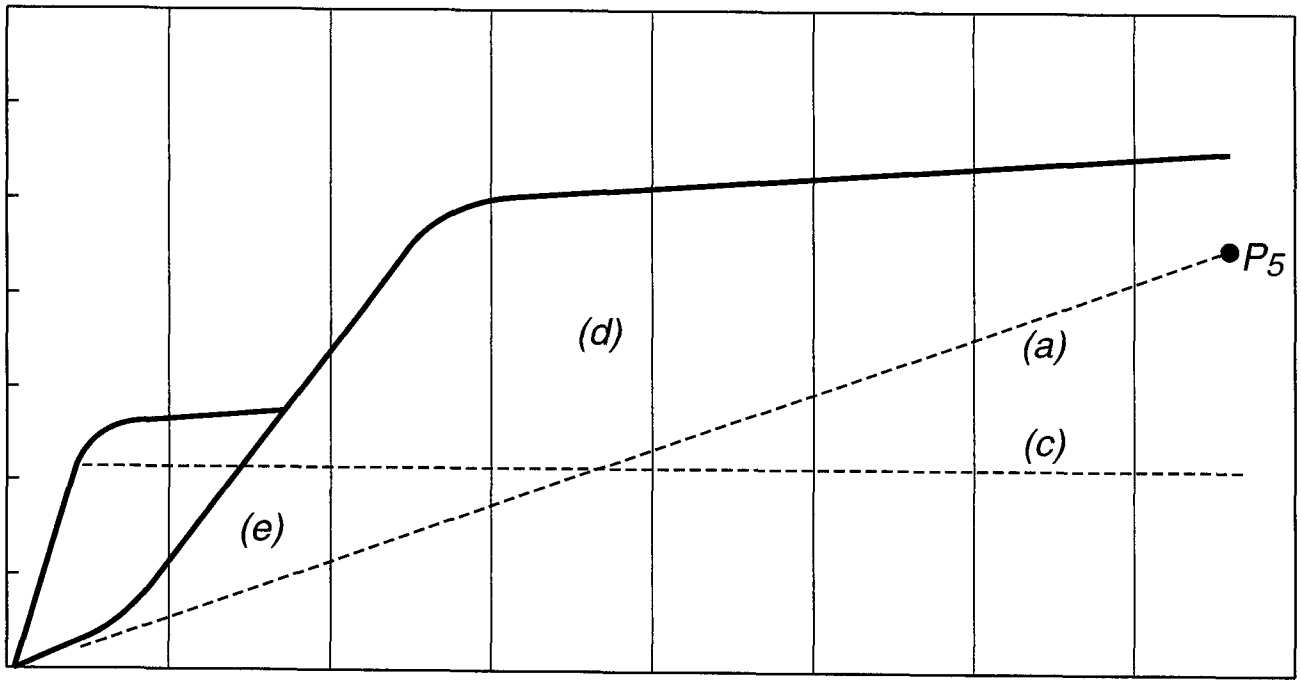
FIG. 13 is a hydraulic pressure characteristic graph in a case where the comparative example of the variable capacitance pump is combined with the comparative example of the control valve.

Hereinafter, an operation of variable capacitance pump 19 will be described. Before the explanation of variable capacitance pump 19, a relationship between a controlled hydraulic pressure according to a comparative example of variable capacitance pump and a required hydraulic pressure for an engine sliding section and/or valve timing control apparatus without use of control valve 22 will be explained on a basis of FIG. 12.

The hydraulic pressure required for the internal combustion engine is mainly determined by the hydraulic pressure required for the lubrication of journal sections of the crankshaft. This has a tendency of increasing with an engine speed as shown in (a) of FIG. 12. In addition, in a case where the valve timing control apparatus is used for an improvement in a fuel economy and exhaust emission counter-measurement, the hydraulic pressure of the variable capacitance pump is used as an operation source of the valve timing control apparatus. Hence, in order to improve an operation response characteristic, the working hydraulic pressure requires a high hydraulic pressure as shown in a dot line (c) in FIG. 12 from a time point of the engine low revolution.

Hence, in a region in which the engine speed is low, major oil flow quantity (hydraulic pressure) for the valve timing control apparatus side (branch passage 21) is required. On the other hand, in a region in which the engine speed is high, major oil flow quantity (hydraulic pressure) is required for the lubricating section (main oil gallery 20).

However, in the internal combustion engine having no control valve 22, the hydraulic pressure at branch passage 21 and that at main oil gallery 20 have approximately equal to each other. Hence, the hydraulic pressure of variable capacitance pump indicates the characteristic shown in a solid line (b) in FIG. 12. In other words, regions (d) and (e) shown in FIG. 12 indicate excessive supply quantities and a power loss is developed in these regions (d) and (e) of FIG. 12.

Therefore, if control valve 22 in this embodiment is used, respective flow quantities of branch passage 21 and main oil gallery 20 are controlled and the hydraulic pressure ($P_1$) of branch passage 21 and the hydraulic pressure ($P_2$) of main oil gallery 20 are set to satisfy the hydraulic pressure (a) required for the lubrication and the hydraulic pressure (c) required for the valve timing control apparatus, respectively. Thus, above-described excessive supply quantity regions (e), (d) can be reduced. Then, the drain quantity of the variable capacitance pump can be reduced and the power loss can be suppressed.

However, even if control valve 22 is used, there is a limit in the suppression of the excessive supply quantity by the variable capacitance pump using a single spring member. Thus, if variable capacitance pump 19 in this embodiment, the excessive supply quantity region (d) can furthermore be suppressed. Consequently, the power loss can furthermore be suppressed.

In more details, first, specific series of operations of variable capacitance pump 19 will be described below. Since the pump drainage pressure of the pump is not sufficiently raised in a region from the start of the engine up to a low engine revolution region, arm 57' of cam ring 45 is pressed against lower surface 58*c* of upper end wall 58*b* of cylinder body 41 by means of the spring force of first coil spring 60 so that variable capacitance pump 19 is in an operation stop state (refer to FIG. 7). At this time, the eccentricity of cam ring 45 is maximum and a pump capacity becomes maximum. Thus, along with the rise in the engine speed, the drained hydraulic pressure is abruptly raised as compared with the comparative example and indicates a characteristic of a solid line of (A) in FIG. 14.

Figure 10:
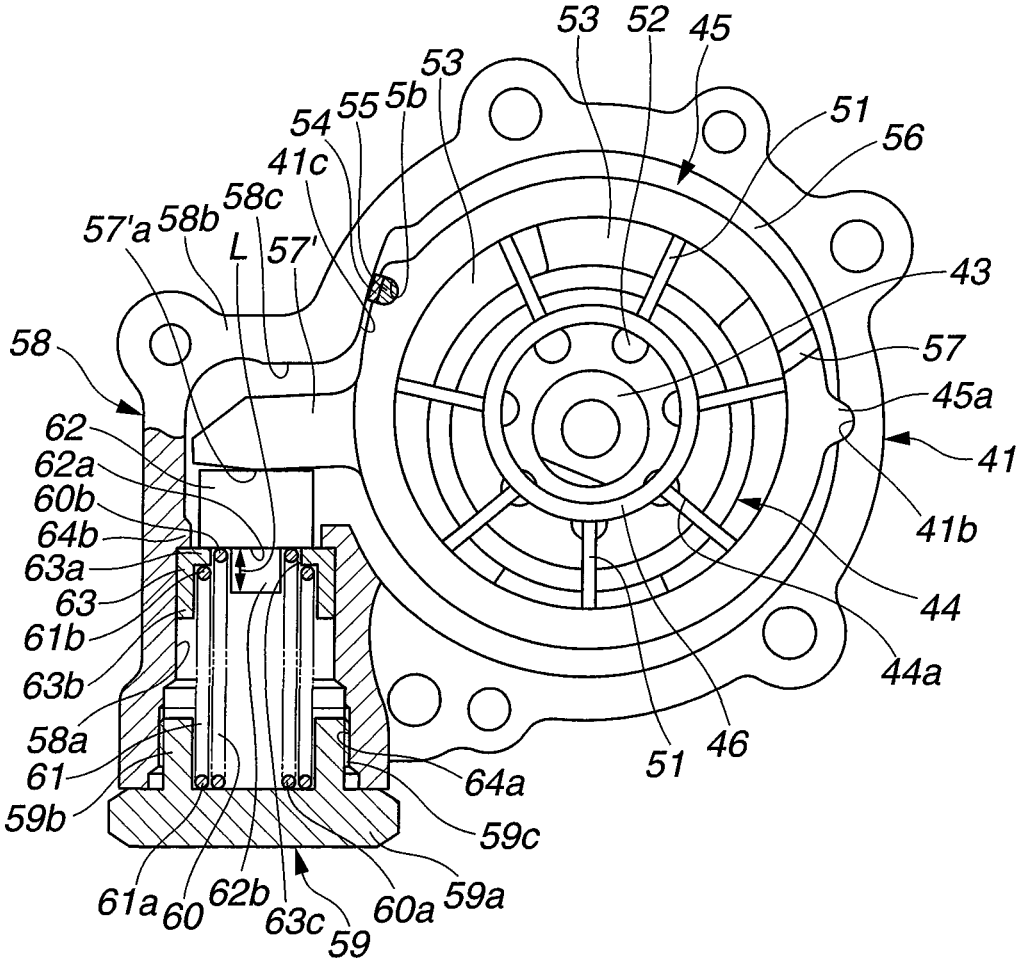
FIG. 10 is a cross sectional view representing an operation of the variable capacitance pump shown in FIG. 7.
Figure 11:
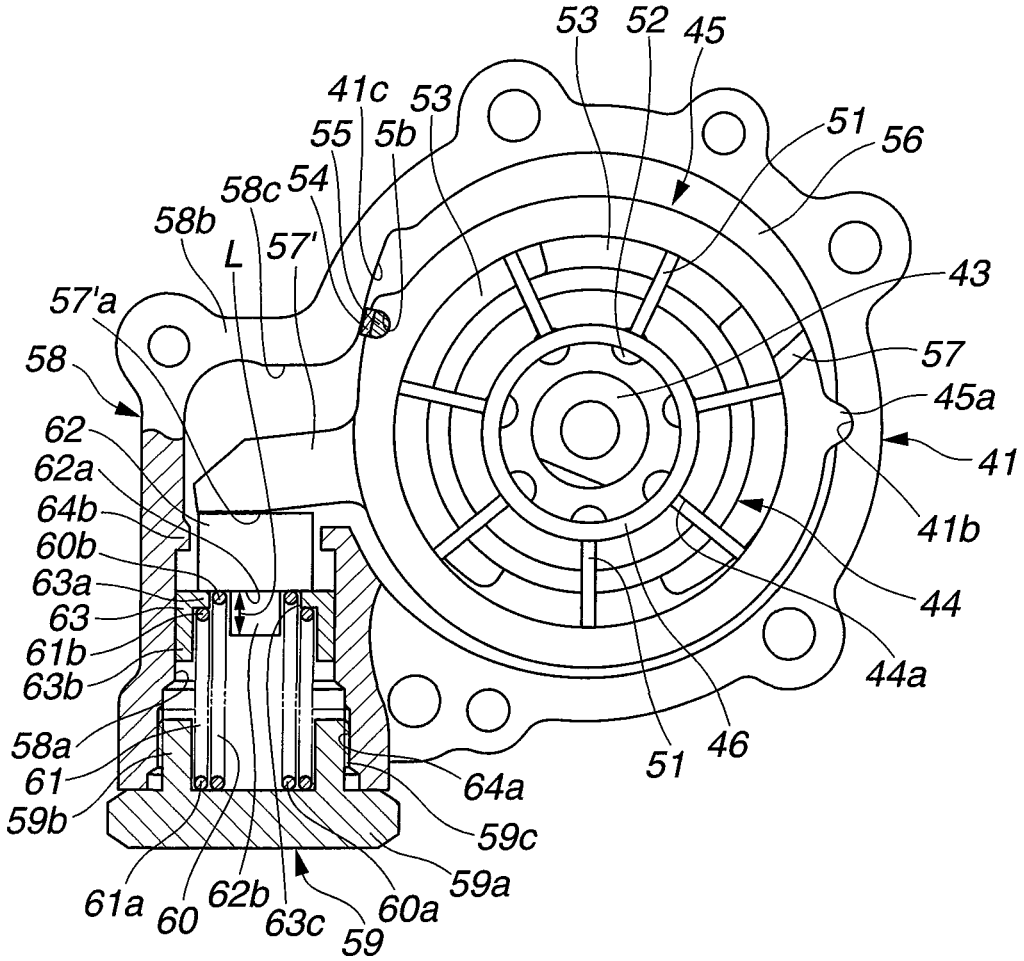
FIG. 11 is a cross sectional view representing an operation of the variable capacitance pump shown in FIG. 7.

Subsequently, when the drained hydraulic pressure is furthermore raised along with the rise of the engine speed and has reached to a predetermined pressure, the introduced hydraulic pressure within control oil chamber 56 becomes high, cam ring 45 starts to compressively deform first coil spring 60 acted upon arm 57' to be eccentrically swung in the counterclockwise direction with pivot point section 45*a* as the fulcrum. Thus, the pump capacity is decreased so that a rise characteristic of the drained hydraulic pressure becomes small (moderate) as denoted in a solid line region of (B) in FIG. 14. Then, as shown in FIG. 10, cam ring 45 is swung in the counterclockwise direction until lower surface 62*a* of first plunger 62 is contacted on the outer periphery of upper wall 63*a* of second plunger 63. In a state of FIG. 10, first plunger 62 is contacted on second plunger 63. From this time point, set weight W2 of second coil spring 61 is added in addition to set weight W1 of first coil spring 60. Cam ring 45 cannot be swung and is retained until the drained hydraulic pressure reaches to the hydraulic pressure within control oil chamber 56 and overcomes set weight W2. Hence, the drained hydraulic pressure together with the rise in the engine speed indicates a rise characteristic as shown in (C) in FIG. 14. Since the eccentricity of cam ring 45 is small and the pump capacity is decreased, the abrupt rise characteristic as shown in (A) of FIG. 14 is not brought out.

Furthermore, when the engine speed is raised and the drained hydraulic pressure becomes equal to or higher than the predetermined pressure, cam ring 45 is swung while compressively deforming both of first and second coil springs 60, 61 against spring force of set weight W2 of second coil spring 61 via arm 57'. Along with the swing of cam ring 45, the pump capacity is furthermore decreased and the rise in the drained hydraulic pressure becomes small. Then, the engine speed reaches to a maximum revolution speed while maintaining a state of characteristic shown in (D) in FIG. 14.

Figure 14:
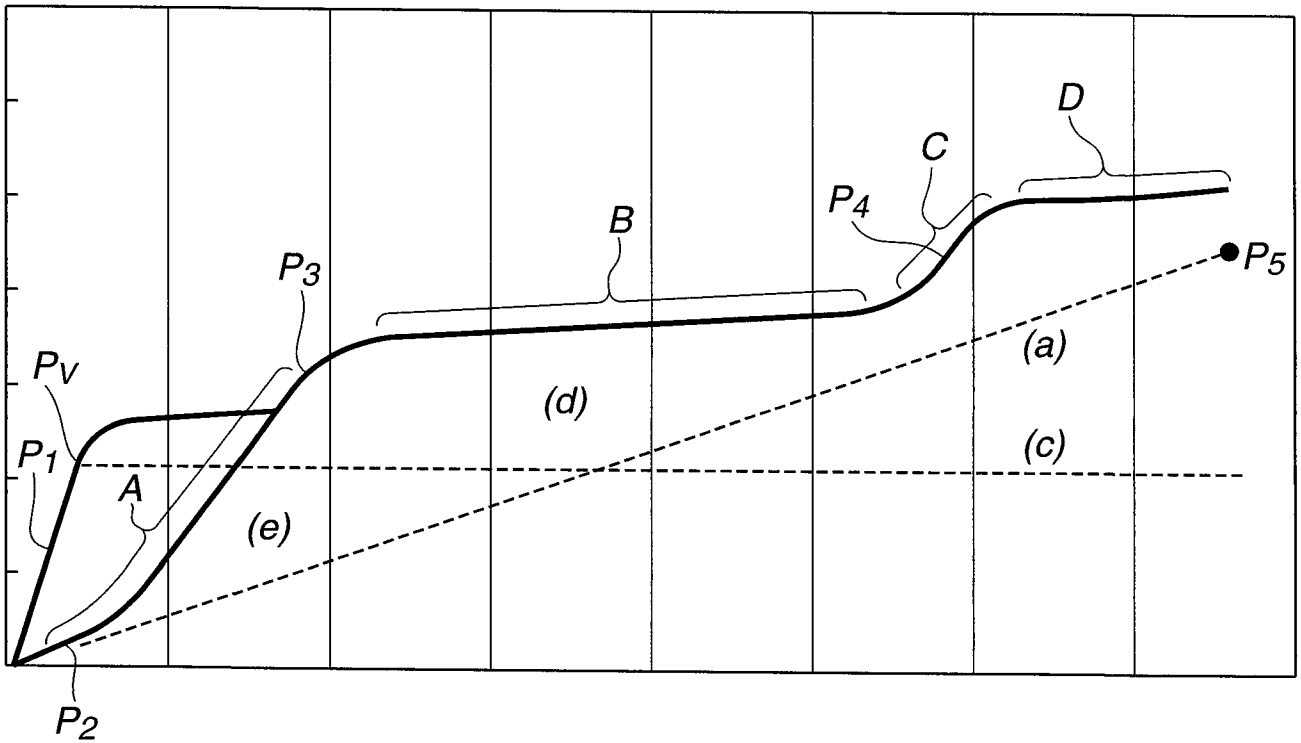
FIG. 14 is a hydraulic pressure characteristic graph in a case where the variable capacitance pump in the first embodiment is combined with the control valve in the first embodiment.

Then, as shown in FIG. 14, hydraulic pressure Pv under which main passage section 15*b* at control valve side 22 is started to communicate with main oil gallery 20 is set to be equal to or higher than hydraulic pressure (c) that the valve timing control apparatus requires and a first stage of hydraulic pressure $P_3$ under which the drained flow quantity of variable capacitance pump 19 is varied is set to be equal to or higher than hydraulic pressure Pv. Thus, excessive supply quantity (d) can be reduced without limitation placed on operation of control valve 22.

Furthermore, a second stage of hydraulic pressure $P_4$ at which the drained oil quantity of variable capacitance pump 19 is varied is set to a maximum value $P_5$ of hydraulic pressure (a) required for the lubrication. Thus, excessive supply quantity region (d) can be reduced while the hydraulic pressure required for the lubrication is maintained.

Figure 15:
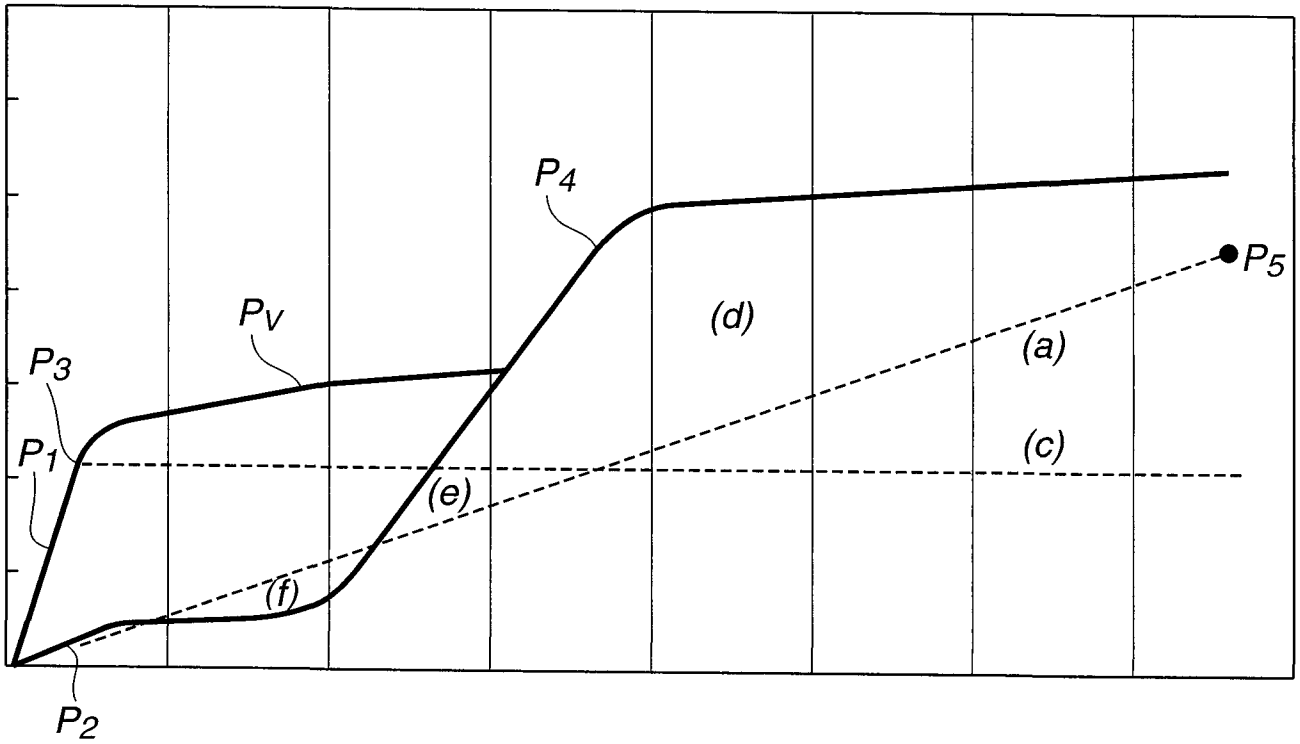
FIG. 15 is a hydraulic pressure characteristic graph in a case where a hydraulic pressure at a first stage of a variation in a drained flow quantity of the variable capacitance pump in the first embodiment is set to be equal to or lower than the hydraulic pressure under which the control valve is opened.

In addition, suppose that the first stage of hydraulic pressure $P_3$ is set to be equal to or lower than Pv described above. In this case, the hydraulic pressure characteristic is shown in FIG. 15. In other words, at a time point at which the hydraulic pressure of variable capacitance pump 19 indicates hydraulic pressure $P_3$, the drained flow quantity of variable capacitance pump 19 is varied. Hence, the rise in the hydraulic pressure becomes moderate. At this time, the hydraulic pressure does not speedily become hydraulic pressure Pv at which main passage section 15*b* at control valve side 22 is started to be communicated with main oil gallery 20 even if the revolution speed is increased. Hence, the oil flow quantity to main oil gallery side 20 becomes insufficient. Consequently, the region shown in (f) of FIG. 15 is developed which does not satisfy hydraulic pressure (a) require for the lubrication.

As described above, a specific structure of variable capacitance pump 19 causes the hydraulic pressure rise characteristic to be set at the second stages and a special setting between initial stage of rising hydraulic pressure and a valve open pressure of control valve 22 permit a sufficient suppression of the excessive supply regions of variable capacitance pump 19. Hence, the power loss can be reduced and a wasteful consumption of the lubricating oil can be suppressed.

In addition, in this embodiment, since two of first and second coil springs 60, 61 are used, the set weights for the respective coil springs can be set in accordance with the variation in the drained hydraulic pressure. Therefore, optimum spring forces for the drained hydraulic pressure can be set.

Since first and second plungers 62, 63 are provided on the tip sides of first and second coil springs 60, 61, an assembly operation becomes easy and the smooth compressive and elongation displacements of first and second springs 60, 61 can be assured without twist of each coil spring 60, 61. It should be noted that, in a case where a movement quantity (displacement) of each plunger 62, 63 and a swing quantity of arm 57' are small, a direct contact of upper end section 60*b* of first coil spring 60 on lower surface 57'*a* of arm 57' without intervention of the plunger is possible.

Since lower surface 57'*a* of arm 57' is formed in the arc-shaped curved surface, the swing of cam ring 45 permits variations of a contact angle onto the upper surface of first plunger 62 and a contact point thereon to be made small. Thus, the displacement of first coil spring 60 can be stabilized. It should be noted that advantages that the upper surface of first plunger 62 is formed in the arc-shaped curved surface are the same as described above.

In addition, in this embodiment, the lubricating oil drained from the drain opening via drain port 8 is utilized as an operation source of the valve timing control apparatus in addition to the lubrication of each slide section of the internal combustion engine. As described above, the rise of an initial stage of the drained hydraulic pressure (a region denoted by (A) in FIG. 14) gives a favorable characteristic. Thus, an operation response characteristic of a relative revolution phase between the timing sprocket 2 and camshaft 1 immediately after the start of engine can be improved. In addition, a variable valve system is not limited to the valve timing control apparatus and the present invention is applicable to, for example, a lift variable mechanism in which the hydraulic pressure is the operation source and a working angle of an engine valve and a lift thereof are varied.

Second Embodiment

Figure 16:
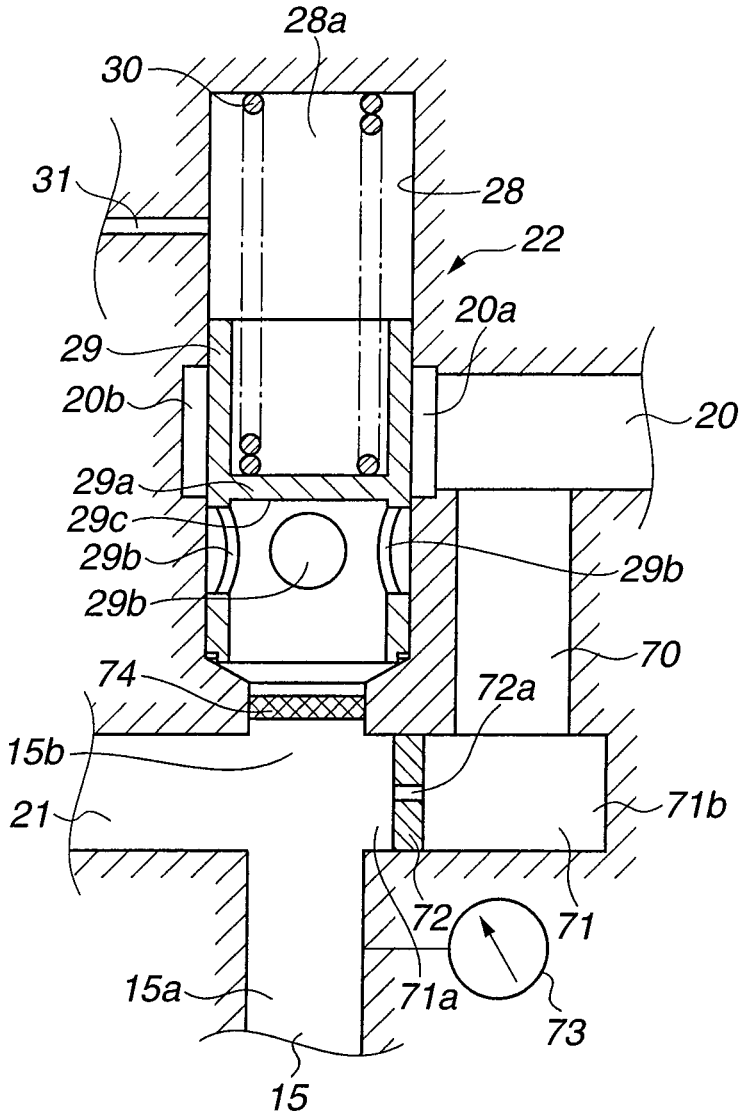
FIG. 16 is a cross sectional view of the control valve in a second preferred embodiment according to the present invention.
Figure 17:
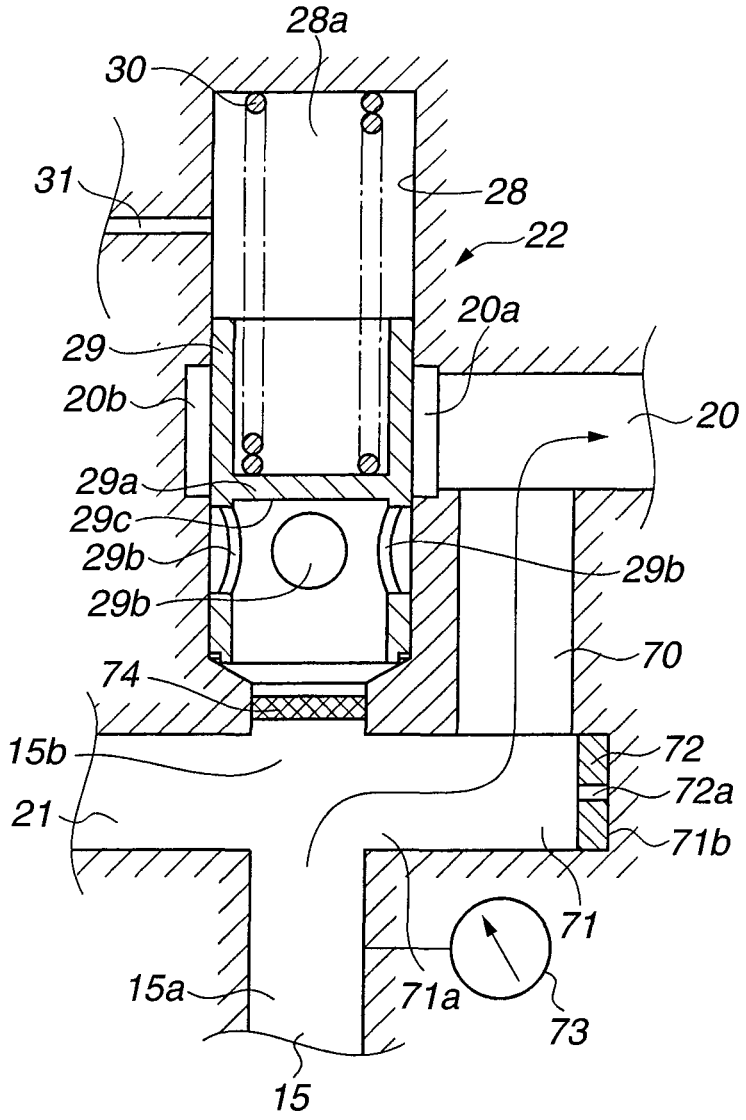
FIG. 17 is a cross sectional view representing an action of the control valve in the second preferred embodiment shown in FIG. 16.

FIGS. 16 and 17 show a second preferred embodiment according to the present invention. In this embodiment, a counter-measurement technique is provided in a case where valve body 29 of control valve 22 fails to operate due to, for example, a catch of contaminations such as metallic powder in a space between valve body 29 and valve hole 28.

That is to say, a bypass passage 70 bypassing control valve 22 and connecting main passage section 15*b* to a proximity of one end opening 20*a* of main oil gallery 20 is provided at a position opposing against branch passage 21 of main passage section 15*b*. A passage cross sectional area of this bypass passage 70 is set to be slightly smaller than the passage cross sectional area of branch passage 21. In addition, one end section of bypass passage 70 at main passage section side 15*b* is constituted by an approximately horizontal column shaped passage section 71 and a disc shaped orifice constituting body 72 is housed within an inner part of an upstream side of passage section 71.

This orifice constituting body 72 corresponds to flow passage cross sectional area enlargement means (a flow passage cross sectional area enlargement section) (a breaker mechanism) and is formed of, for example, a synthetic resin material or a metallic material. In addition, a small diameter orifice 72*a* is penetrated through a center position thereof 72. This orifice constituting body 72 is slidably installed within passage section 71 from one end side 71*a* to the other end side 71*b* as shown in FIGS. 16 and 17. In a case where the hydraulic pressure within main passage section 15*b* is equal to or higher than a preset pressure, orifice constituting body 72 is movable from one end side 71*a* to the other end side 71*b* along the inner peripheral surface of passage section 71. Thus, the bypass passage 70 is opened (the passage area is expanded).

A pressure sensor 73 is disposed on an introduction section 15*a* located at downstream of main passage section 15*b* for detecting the hydraulic pressure within the inside of main passage section 15*b* as pressure detecting means (a pressure detecting section). Controller 27 receives a hydraulic pressure information signal detected by this pressure sensor 73. If pressure sensor 73 detects a larger pressure than the preset pressure value, controller 27 outputs an illumination command signal to an alarm lamp 27' installed in an instrument panel to inform a vehicle driver of the above-described the larger pressure.

A filter 74 is installed to collect the contaminations described above and so forth at a connection portion of the main passage section 15*b* to valve hole 28. It should be noted that, in this case, a filter 24 used in the first embodiment may not be installed but may be installed in a double structure.

The other structures on control valve 22 are the same as those described in the first embodiment. The common elements are designated with the same reference numerals and the description thereof will herein be omitted.

Hence, according to the second embodiment, in a case where valve body 29 become sticky due to the operation failure thereof in a valve closure state shown in FIG. 16, oil drained from variable capacitance pump 19 into supply passage 15 is supplied to branch passage 21 so as to supply of operation of the valve timing control apparatus and, at the same time, is supplied to main oil gallery 20 slightly from orifice 72*a* via bypass passage 70. At this time, the hydraulic pressure within main passage section 15*b* is raised along with the increase in the drained flow quantity described above.

Then, if the above-described hydraulic pressure becomes equal to or higher than the predetermined pressure, this high hydraulic pressure causes orifice constituting body 72 to be pressed and moved from one end section 71*a* of passage section 71 to the other end section 71*b* to open bypass passage 70, namely, to achieve the expansion of the passage cross sectional area. Thus, the breaker function is acted so that the drained oil is, as shown by an arrow-marked line in FIG. 17, supplied from main passage section to main oil gallery 20 via bypass passage 70. From this bypass passage 70, the drained oil is forcefully supplied to each lubricating section of the internal combustion engine. Thus, the sufficient quantity of lubricating oil to the respective lubricating (slide) sections is secured to improve the lubricating performance and the development of a baking can be suppressed.

In addition, the information of the excessive pressure rise within main passage section 15*b* is informed to the driver by illuminating alarm lamp 27' from pressure sensor 73 via controller 27.

As described above, a large quantity of oil is supplied from bypass passage 70 to main oil gallery 20 so that the oil supply flow quantity to branch passage 21 is decreased and the operation response characteristic of the valve timing control apparatus is reduced. Consequently, there is a possibility of reduction in the output and worsening of fuel consumption.

However, in this embodiment, the passage cross sectional area of bypass passage 70 is smaller than that of branch passage 21. Hence, the worsening of the operation response characteristic of the valve timing control apparatus can be suppressed.

In addition, even if the operation response characteristic of the valve timing control apparatus is reduced, an ordinary vehicle traveling is possible. Hence, there is a possibility that control valve 22 is left as it is without repair. However, the illumination of alarm lamp 27' informs the driver of the failure, a speedy counter-measurement can be achieved.

It should be noted that, as the means for detecting the failure of control valve 22, failure detecting means may include the detection that the operation response characteristic is slower than an ordinary response characteristic in addition to pressure sensor 73.

Third Embodiment

Figure 18:
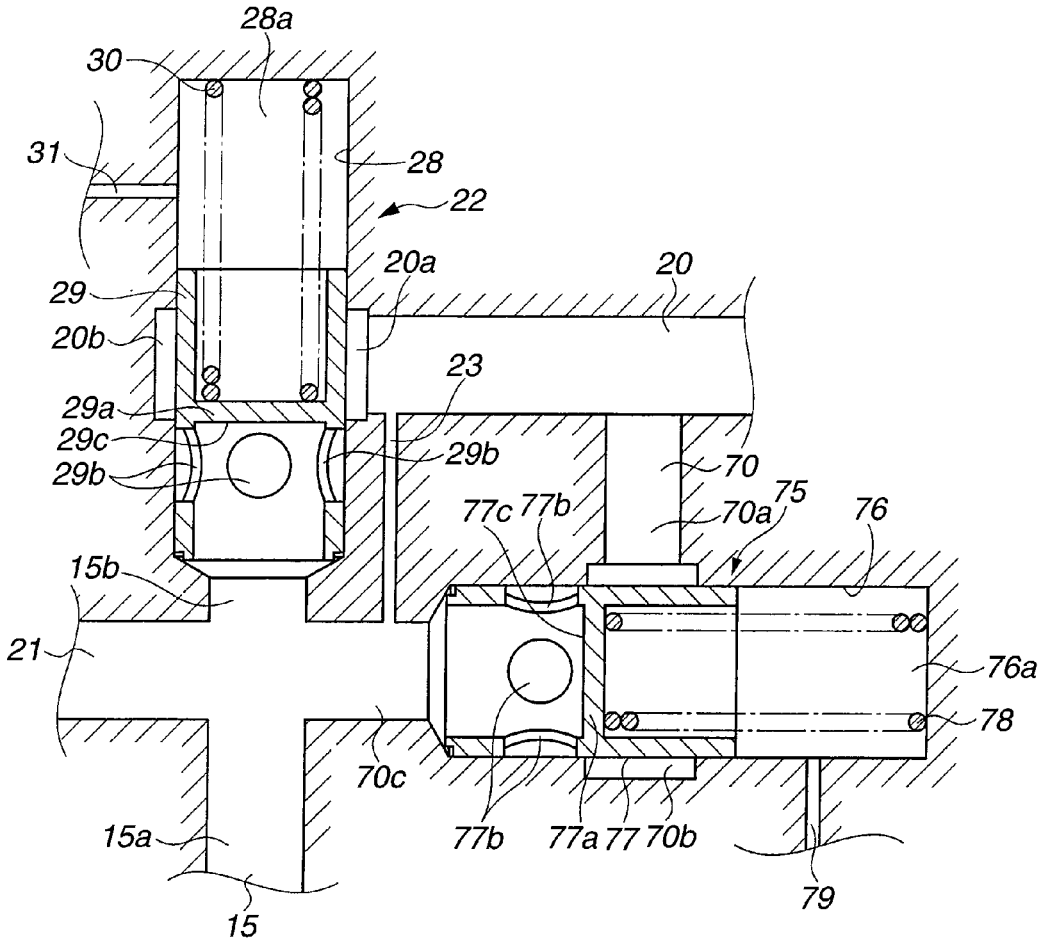
FIG. 18 is a cross sectional view representing the control valve in a third preferred embodiment.
Figure 19:
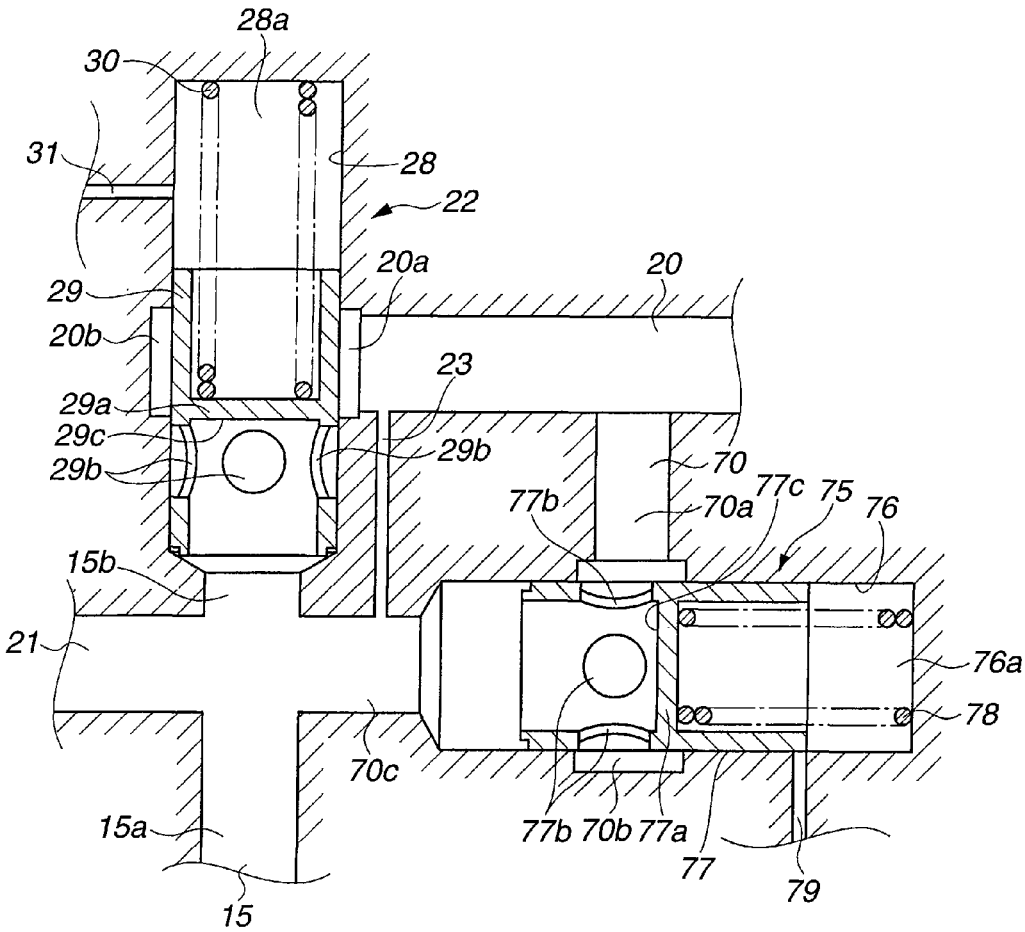
FIG. 19 is a cross sectional view representing an action of the control valve in the third embodiment shown in FIG. 18.

FIGS. 18 and 19 show a third preferred embodiment according to the present invention. In the third embodiment, a relief valve 75 having the same structure as control valve 22 is installed in a midway through bypass passage 70 described in the second embodiment.

That is to say, bypass passage 70 is folded and formed in an approximately letter-L shape and a doughnut shaped groove 70*b* is formed at an opening section 70*a* in a midway through a passage section of bypass passage 70 at a opening side 70*a*.

That is to say, relief valve 75 is mainly constituted by a cylindrical second valve hole 76 formed at a position of bypass passage corresponding to the passage section of bypass passage; a second valve body 77 of an approximately cylindrical shape installed slidably within second valve hole 76; and a second valve spring 78 which is a second biasing member for biasing second valve body 77 in a closure direction.

Second valve hole 76 has its tip section 76*a* to be communicated with main passage section 15*b* from the axial direction via a downstream end section 70*c* of bypass passage 70 and its approximately center position in the axial direction thereof exposed to doughnut shaped groove 70*b* of bypass passage 70 described above.

Second valve body 77 has disc-shaped partitioning wall 77*a* integrally installed at the approximately center position in the axial direction thereof and a plurality of opening holes 77*b* are penetrated along the diameter direction and respective opening holes 77*b* are communicated with doughnut shaped groove 70*b* in accordance with the slide position of second valve body 77. It should be noted that an end surface of partitioning wall 77*a* at main passage section side 15*b* is constituted as a second pressure receiving surface 77*c* receiving the hydraulic pressure introduced from main passage section 15*b*.

One end of second valve spring 78 is elastically contacted on a bottom surface of second valve hole 76 and the other end thereof is elastically contacted on an end surface opposite to second pressure receiving surface 77*c* of partitioning wall 77*a*. The spring force of valve spring 78 biases second valve body 77 in the leftward direction as shown in FIGS. 18 and 19 to interrupt the communication between respective opening holes 77*b* and doughnut-shaped groove 70*b*. In more details, doughnut-shaped groove 70*b* is closed by a peripheral wall located at a more rightward end section than partitioning wall 77*a* of second valve body 77.

In addition, a housing chamber 76*a* in which second valve spring 78 of second valve hole 76 is housed is communicated externally via a second air vent hole 79. Thus, a favorable sliding capability of second valve body 77 can be secured.

It should be noted that orifice passage 23 is connected between downstream end 70*c* of bypass passage 70 and main oil gallery 20 in the same manner as described in the first embodiment.

Then, as described above, when the hydraulic pressure drained from variable capacitance pump 19 to supply passage 15 due to the operation failure of sticky valve body 29 of control valve 22 is raised to the predetermined pressure within main passage section 15*b*. This hydraulic pressure is acted upon second pressure receiving section 77*c* of second valve body 77. When this pressure becomes larger than the set weight of second valve spring 78, second valve body 77 is retracted and respective opening holes 77*b* and doughnut shaped groove 70*b* are communicated with each other (refer to FIG. 19). Thus, the drained oil within supply passage 15 is supplied to main oil gallery 20 via second valve body 77.

Therefore, the action and advantages of the third embodiment can be obtained in the same way as the second embodiment.

Fourth Embodiment

Figure 20:
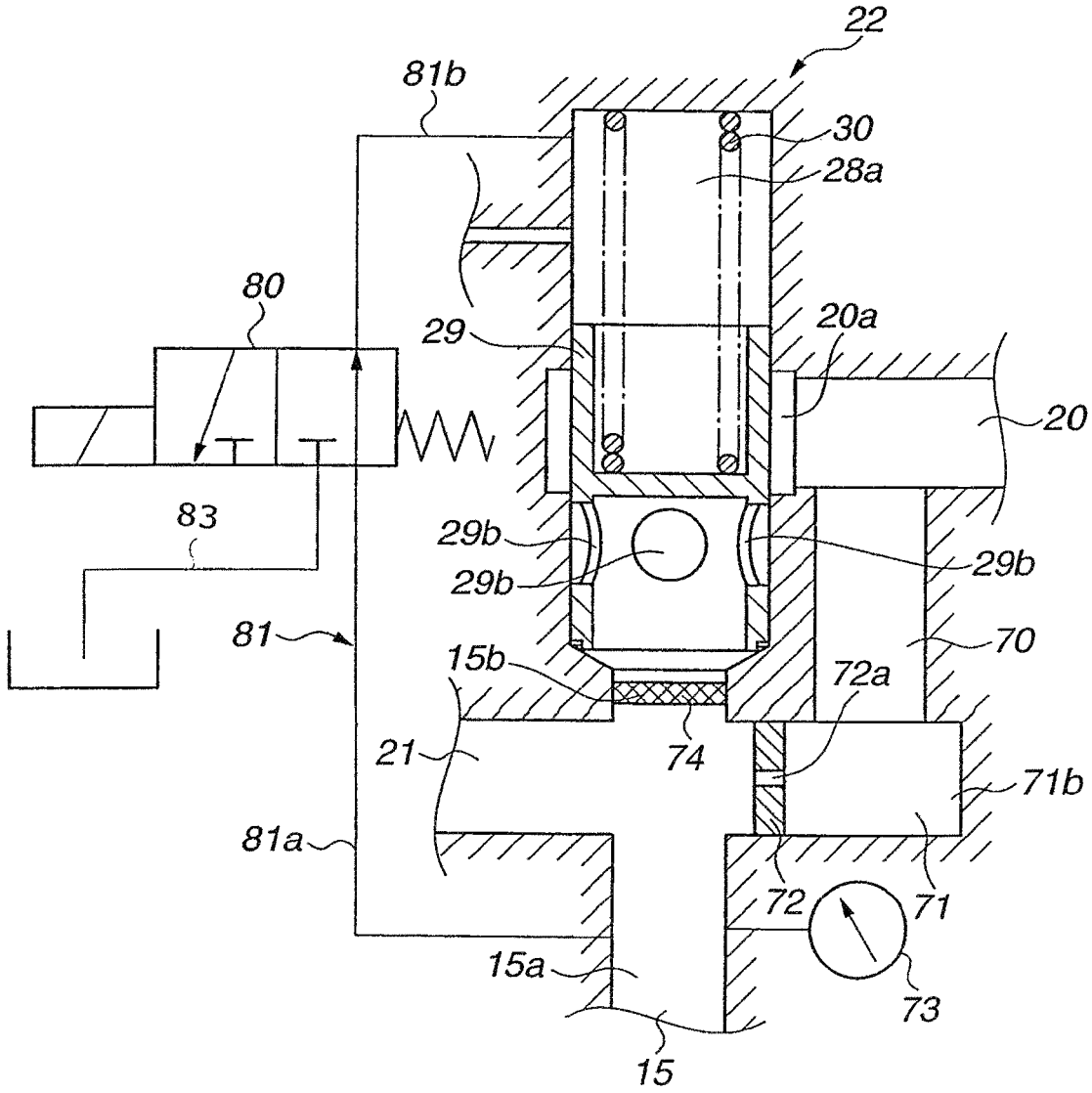
FIG. 20 is a cross sectional view of the control valve in a fourth preferred embodiment according to the present invention.
Figure 21:
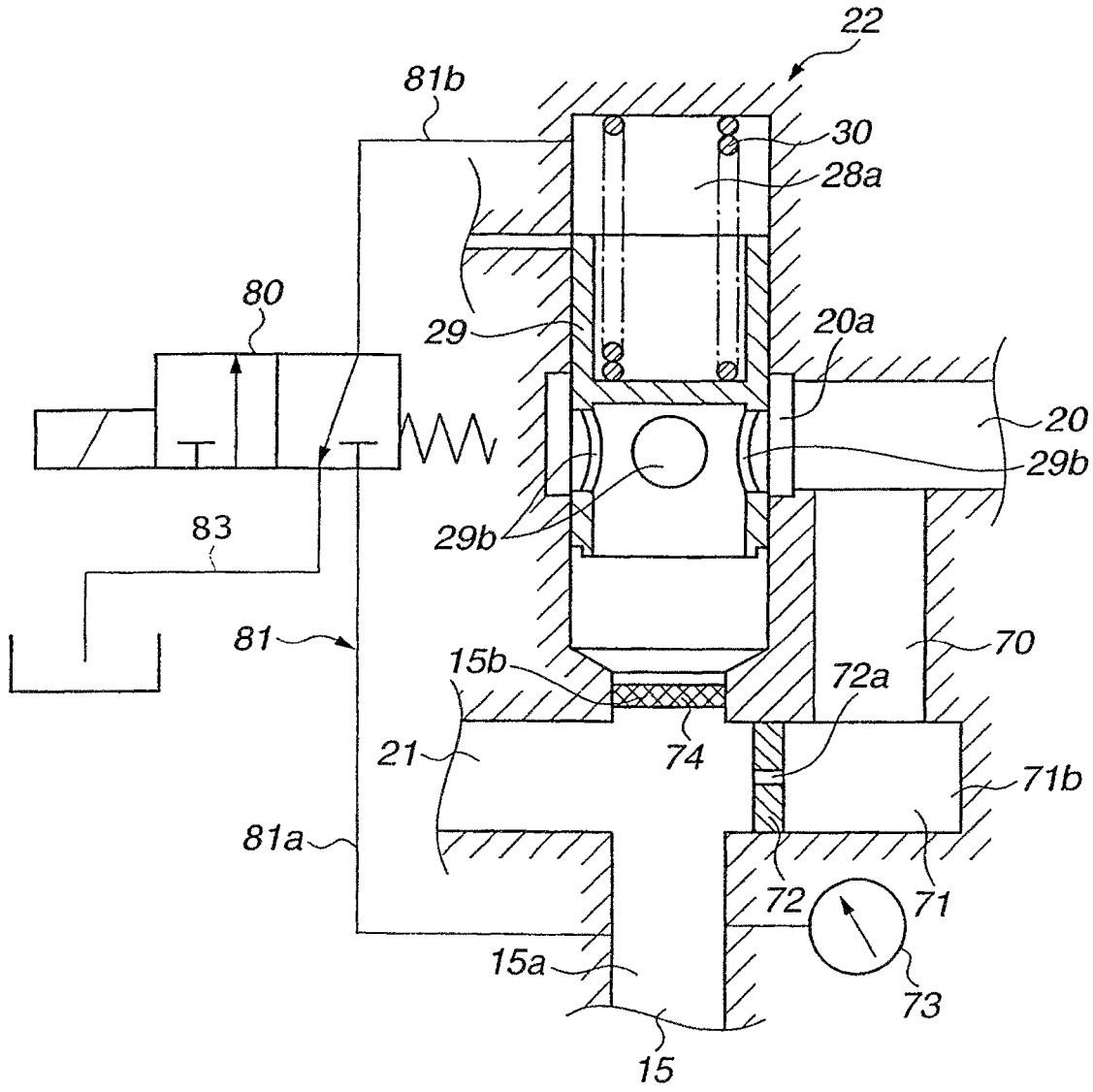
FIG. 21 is a cross sectional view representing an action of a control valve in the fourth embodiment shown in FIG. 20.

FIGS. 20 and 21 show a fourth preferred embodiment according to the present invention. The fourth embodiment is structured with the structure of the second embodiment as a prerequisite and valve body 29 of control valve 22 is operated by an electromagnetic valve 80 utilizing the hydraulic pressure of supply passage 15.

That is to say, a basic structure of whole control valve 22 is the same as described in each of the first through fourth embodiments. The spring force of valve spring 30 (which is the biasing member) is set to a degree such as to merely bias valve body 29 toward the closure direction in a case where the hydraulic pressure is not acted upon valve body 29.

A communication passage 81 communicating introduction section 15*a* of supply passage 15 and housing member 28*a* of control valve 22 is installed between a proximity of introduction section 15*a* of supply passage 15 and housing chamber 28*a* of control valve 22 and electromagnetic valve 80 is intervened in the midway through communication passage 81.

This communication passage 81 is constituted by a first passage section 81*a* between introduction passage 15*a* and electromagnetic valve 80 and a second passage section 81*b* between electromagnetic valve 80 and housing chamber 28*a*. Second passage section 81*b* utilizes air vent hole 31 and is appropriately communicated with drain passage 83 via electromagnetic valve 80.

Electromagnetic valve 80 is a generally available two-direction-and-two-position valves in which communication passage 81 is opened to supply the hydraulic pressure at introduction section side 15*a* to housing chamber 28*a* or the oil within housing chamber 28*a* is drained into oil pan 18 via second passage section 81*b*. A differential pressure before and after valve body 29 (at a first pressure receiving surface side 29*c* and at a housing chamber side 28*a*) is developed to adjust a slide position of valve body 29 so that a relative opening area between opening hole 29*b* and doughnut shaped groove 20*a* is controlled.

In addition, the operation of this electromagnetic valve 80 is controlled according to a control current outputted from controller 27.

The other structures are the same as those described in the second embodiment and their explanations will be omitted with like reference numerals designated with the common elements.

Hence, in this embodiment, in a state where the engine is started and in a state where the engine is revolved in the low revolution region, the drained hydraulic pressure of variable capacitance pump 19 is not sufficiently raised. Hence, the hydraulic pressure within main passage section 15*b* is low. Thus, with no supply of electromagnetic valve 80 thereto, control valve 22 maintains the closure state as shown in FIG. 20. Thus, oil drained into supply passage 15 is mainly supplied to branch passage 21 to be used for the operation of the valve timing control apparatus and is supplied to respective lubricating sections from bypass passage 70 to main oil gallery 20 via orifice 72*a* of orifice constituting body 72.

On the other hand, when the drained flow quantity of variable capacitance pump 19 is increased with the engine speed raised and the hydraulic pressure within main passage section 15*b* is raised, the control current from controller 27 operatively controls electromagnetic valve 80. This determines the slide position of valve body 29 according to a magnitude of a differential pressure developed before and after valve body 29. Then, as shown in FIG. 21, when valve body 29 is displaced within housing chamber 28*a* maximally upward direction, both respective opening holes 29*b* and doughnut shaped groove 20*b* are wholly open so that a major quantity of oil is supplied to main oil gallery 20 from this bypass passage 70. Hence, the same action and advantages in the second embodiment can be obtained in the fourth embodiment.

The present invention is not limited to the structure of each of the embodiments. For example, the valve timing apparatus is applicable to an exhaust valve side and the set weights of first and second coil springs 60, 61 for variable capacitance pump 19 may be modified. It should be noted that, in each of FIGS. 12 through 15, a lateral axis denotes the engine speed and a longitudinal axis denotes a pressure value.

Hereinafter, technical concepts of the present invention other than independent claims 1 through 3 will be described.

(Claim 4)

The apparatus as claimed in claim 1, wherein the variable capacitance pump comprises: a pump constituting body including a plurality of working oil chambers whose volumes are varied by being rotatably driven by the internal combustion engine to drain oil introduced from a suction section through a drain section;

a variable mechanism configured to vary a volumetric variation quantity of the working oil chambers open to the drain section by moving a movable member;

a first biasing member configured to provide a biasing force for the movable member in a direction for the volumetric variation quantity of the working oil chambers opened to the draining section to become large;

and a first pressure receiving section configured to move the movable member against a biasing force of the first biasing member upon receipt of the pressure of the drained oil and the control valve comprises:

a second biasing member configured to bias the valve body in a direction for an oil flow quantity supplied to the supply section to be deceased; and a second pressure receiving section configured to move the valve body against the biasing force of the second biasing member upon receipt of the pressure of an upstream side of the valve body, and wherein a multiplication value of a set weight of the first biasing member by a pressure receiving area of the first pressure receiving member is larger than the multiplication value of the set weight of the second biasing member by the pressure receiving area of the second pressure receiving member.

(Claim 5)

The apparatus as claimed in claim 1, wherein the pressure under which the drained flow quantity of the variable capacitance pump is started to be varied is higher that the pressure under which valve body of the control valve is moved in order for the oil flow quantity to the supply section to become maximum.

(Claim 6)

The apparatus as claimed in claim 2, wherein the hydraulic pressure circuit further comprises a flow passage cross sectional area enlargement section configured to be immovable in a state in which the valve body of the control valve decreases the oil supply quantity to the supply section and to enlarge a flow passage cross sectional area of a bypass passage, the bypass passage being configured to cause oil supplied from the introduction section to the supply section when a pressure acted upon the valve body is equal to or higher than a predetermined pressure, and wherein the pressure under which the drained flow quantity of the variable capacitance pump is started to be varied is higher than a pressure under which the flow passage area enlargement section enlarges the flow passage area.

(Claim 7)

The apparatus as claimed in claim 2, wherein the variable capacitance pump comprises: a rotor rotatably driven by the internal combustion engine; a cam ring having an inner periphery on which the rotor is housed; and a vane retractably and advanceably disposed on the rotor and configured to partition a plurality of working oil chambers by a projection thereof toward the cam ring side, and wherein the cam ring is moved in accordance with the pressure of the drained oil in order for an eccentricity between a center of the cam ring and a center of the rotor to be variable.

(Claim 8)

A control valve apparatus comprising: a hydraulic pressure circuit including: an introduction section into which oil is introduced; a main passage section installed at a downstream side of the introduction section to communicate with a supply section supplying oil to each lubricating section of an internal combustion engine; and a control valve having a valve body which is moved to control an oil flow quantity to the supply section, the control valve apparatus further comprises a flow passage cross sectional area enlargement section configured to enlarge a cross sectional area of a flow passage through which oil is caused to flow into the supply section from the introduction section when the valve body becomes immovable.

(Claim 9)

The control valve apparatus as claimed in claim 8, wherein the flow passage cross sectional area enlargement section is a breaker mechanism configured to release a fixture state thereof to enlarge the flow passage cross sectional area when a pressure at the main passage section is equal to or higher than a predetermined pressure.

(Claim 10)

The control valve apparatus as claimed in claim 9, wherein the control valve apparatus further comprises a detecting section configured to detect that the breaker mechanism enlarges the flow passage.

(Claim 11)

The control valve apparatus as claimed in claim 10, wherein the hydraulic pressure actuator is a variable valve mechanism configured to vary an operation of an engine valve and to enable a detection of an operation state thereof and wherein the detecting section detects the enlargement of the flow passage cross sectional area according to an operation response characteristic of the variable valve mechanism in a state in which the valve body decreases the flow quantity of the valve body to the supply section.

According to the present invention, in a case where the breaker mechanism expands the flow passage cross sectional area in a state in which the valve body of the control valve is, for example, sticky and is difficult to be moved, a majority of oil is caused to flow into the bypass passage so that an operation response characteristic of the variable valve mechanism is reduced. This response reduction state is detected by, for example, the pressure sensor described above. Consequently, a detection accuracy is improved.

(Claim 12)

A control valve apparatus comprising: a hydraulic pressure circuit including: an introduction passage into which oil is introduced from an oil pump; a main passage installed at a downstream side of the introduction section and communicated with a supply passage through which oil is supplied to each lubricating section of an internal combustion engine; a branch passage branched from the main passage and through which oil is supplied to a hydraulic pressure actuator: and a control valve having a valve body which is moved to control an oil flow quantity to the supply section, wherein the control valve comprises: a biasing member configured to bias the valve body in a direction for the flow quantity to the supply section to be decreased; a pressure receiving section configured to receive a pressure at an upstream side of the valve body to move the valve body against a biasing force of the biasing member; a bypass passage communicating between the upstream side of the valve body and a downstream side of the valve body; and a relief valve installed on the bypass passage to increase a flow quantity of oil passing through the bypass passage when a pressure of an upstream side of the valve body is equal to or higher than a pressure under which the valve is moved against the biasing force of the biasing member.

(Claim 13)

The control valve apparatus as claimed in claim 8, wherein, in a case where the detecting section detects that the flow passage cross sectional area enlargement section enlarges the flow passage cross sectional area, an alarm is issued.

(Claim 14)

The control valve apparatus as claimed in claim 8, wherein a filter is interposed between the branch passage at a downstream side of the main passage and the control valve.

(Claim 15)

A control valve apparatus comprising: a hydraulic pressure circuit including: an introduction passage into which oil is introduced from an oil pump; a main passage installed at a downstream side of the introduction section and communicated with a supply passage through which oil is supplied to each lubricating section of an internal combustion engine; a branch passage branched from the main passage and through which oil is supplied to a hydraulic pressure actuator: and a control valve having a valve body which is moved to control an oil flow quantity to the supply section, wherein the control valve comprises: a biasing member configured to bias the valve body in a direction for the flow quantity to the supply section to be decreased; a pressure receiving section configured to receive a pressure at an upstream side of the valve body to move the valve body against a biasing force of the biasing member; a bypass passage communicating between the upstream side of the valve body and a downstream side of the valve body; and a relief valve installed on the bypass passage to increase a flow quantity of oil passing through the bypass passage when a pressure of an upstream side of the valve body is equal to or higher than a pressure under which the valve is moved against the biasing force of the biasing member.

(Claim 16)

The control valve apparatus as claimed in claim 8, wherein the control valve apparatus further comprises an electromagnetic valve and the valve body of the control valve is driven by a differential pressure developed by the electromagnetic valve.

(Claim 17)

The control valve apparatus as claimed in claim 16, wherein the control valve further comprises a pressure receiving section by which an operation force for the valve body is developed in the same direction as the biasing force of the biasing member and a pressure switched between the pressure at the upstream side of the valve body and a low pressure lower than the pressure at the upstream side of the biasing member is acted upon the pressure receiving section.

This application is based on a prior Japanese Patent Application No. 2009-234148 filed in Japan on Oct. 8, 2009. The entire contents of this Japanese Patent Application No. 2009-234148 are herein incorporated by reference in its entirety. Although the invention has been described above by reference to certain embodiments of the invention, the invention is not limited to the embodiment described above. Modifications and variations of the embodiments described above will occur to those skilled in the art in light of the above teachings. The scope of the invention is defined with reference to the following claims.

What is claimed is:

1. A control valve apparatus comprising:

a variable capacitance pump configured to vary a drained flow quantity in accordance with a drained pressure of oil;

a hydraulic pressure circuit including an introduction section through which oil is introduced from the variable capacitance pump, a main passage section communicated with a supply section supplying oil to each slide section of an internal combustion engine, and a branch passage section branched from the main passage section to supply oil to a hydraulic pressure actuator; and a control valve installed in the hydraulic pressure circuit to control an oil flow quantity from the introduction section to the supply section by moving a valve body of the control valve in accordance with a hydraulic pressure of the introduction section, wherein the hydraulic pressure circuit includes the variable capacitance pump and the control valve sets the hydraulic pressure ($P_v$) of the introduction section under which the valve body of the control valve begins to move to start a communication between the main passage section at the control valve side and the supply section to be lower than a first stage of the hydraulic pressure ($P_3$) of the variable capacitance pump under which the drained flow quantity of the variable capacitance pump begins to be varied.

2. The apparatus as claimed in claim 1, wherein the variable capacitance pump comprises:

a pump constituting body including a plurality of working oil chambers whose volumes are varied by being rotatably driven by the internal combustion engine to drain oil introduced from a suction section through a drain section;

a variable mechanism configured to vary a volumetric variation quantity of the working oil chambers open to the drain section by moving a movable member;

a first biasing member configured to provide a biasing force for the movable member in a direction for the volumetric variation quantity of the working oil chambers opened to the draining section to become large; and a first pressure receiving section configured to move the movable member against a biasing force of the first biasing member upon receipt of the pressure of the drained oil and the control valve comprises:

a second biasing member configured to bias the valve body in a direction for an oil flow quantity supplied to the supply section to be deceased; and a second pressure receiving section configured to move the valve body against the biasing force of the second biasing member upon receipt of the pressure of an upstream side of the valve body, and wherein a multiplication value of a set weight of the first biasing member by a pressure receiving area of the first pressure receiving member is larger than the multiplication value of the set weight of the second biasing member by the pressure receiving area of the second pressure receiving member.

3. The apparatus as claimed in claim 1, wherein a second stage of the hydraulic pressure ($P_4$) of the variable capacitance pump under which the drained flow quantity of the variable capacitance pump also begins to be varied is set to be higher than the hydraulic pressure ($P_5$) of the introduction section under which the valve body of the control valve is moved in order for the oil flow quantity to the supply section to become maximum.

4. A variable capacitance pump apparatus comprising:

a hydraulic pressure circuit including an introduction section through which oil is introduced, a main passage section installed at a downstream side of the introduction section to be communicated with a supply section through which oil is supplied to each of slide sections of an internal combustion engine, a branch passage section branched from the main passage section to supply oil to a hydraulic pressure actuator, and a control valve having a valve body which is moved in accordance with a pressure of an upstream side of the control valve; and a variable capacitance pump configured to drain oil to the introduction section of the hydraulic pressure circuit, wherein the variable capacitance pump is configured to vary a drained flow quantity in accordance with the drained pressure of oil and the hydraulic pressure circuit includes the variable capacitance pump and the control valve sets a first stage of a hydraulic pressure ($P_3$) of the variable capacitance pump under which the oil drained flow quantity of the variable capacitance pump begins to be varied to be higher than the hydraulic pressure ($P_v$) of the introduction section under which the valve body of the control valve begins to move to start a communication between the main passage section at the control valve side and the supply section.

5. The apparatus as claimed in claim 4, wherein the hydraulic pressure circuit further comprises a flow passage cross sectional area enlargement section configured to be immovable in a state in which the valve body of the control valve decreases the oil supply quantity to the supply section and to enlarge a flow passage cross sectional area of a bypass passage, the bypass passage being configured to cause oil supplied from the introduction section to the supply section when a pressure acted upon the valve body is equal to or higher than a predetermined pressure, and wherein the pressure under which the drained flow quantity of the variable capacitance pump is started to be varied is higher than a pressure under which the flow passage area enlargement section enlarges the flow passage area.

6. The apparatus as claimed in claim 4, wherein the variable capacitance pump comprises:

a rotor rotatably driven by the internal combustion engine;

a cam ring having an inner periphery on which the rotor is housed;

biasing means for biasing the cam ring toward a direction at which the cam ring provides a maximum eccentricity at all times; and a vane retractably and advanceably disposed on the rotor and configured to partition a plurality of working oil chambers by a projection thereof toward the cam ring side, and wherein the cam ring is moved in accordance with the pressure of the drained oil in order for an eccentricity between a center of the cam ring and a center of the rotor to be variable and the hydraulic pressure of the variable capacitance pump under which the oil drained flow quantity of the variable capacitance pump begins to be moved is a hydraulic pressure at which the cam ring begins to be moved against a biasing force of the biasing means.

7. A hydraulic pressure circuit of an internal combustion engine, comprising:

an introduction section through which oil is introduced from a variable capacitance pump configured to vary a drained flow quantity in accordance with a drained pressure of oil;

a main passage section communicated with a supply section supplying each slide section of an internal combustion engine; a branch passage section branched from the main passage section to supply oil to a hydraulic pressure actuator; and a control valve configured to control an oil flow quantity to the supply section by moving a valve body of the control valve in accordance with a hydraulic pressure of the introduction section, wherein the hydraulic pressure circuit includes the variable capacitance pump and the control valve sets the hydraulic pressure ($P_v$) of the introduction section under which the valve body of the control valve begins to move to start a communication between the main passage section at the control valve side and the supply section to be lower than a first stage of the hydraulic pressure ($P_3$) of the variable capacitance pump under which the drained flow quantity of the variable capacitance pump begins to be varied.

* * * * *